US012781517B2

(12) United States Patent
Schneider et al.

(10) Patent No.: US 12,781,517 B2
(45) Date of Patent: Nov. 3, 2026

(54) SYSTEM AND METHOD FOR DECKING TILES

(71) Applicant: Barrette Outdoor Living, Inc., Middleburg Heights, OH (US)

(72) Inventors: Christopher Michael Schneider, Linwood, NJ (US); Christopher J. Heritage, Swedesboro, NJ (US); Evan Carl Parker, Jr., Egg Harbor Township, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 264 days.

(21) Appl. No.: 18/532,138

(22) Filed: Dec. 7, 2023

(65) Prior Publication Data

US 2024/0110390 A1 Apr. 4, 2024

Related U.S. Application Data

(63) Continuation-in-part of application No. 18/210,707, filed on Jun. 16, 2023, now abandoned, which is a (Continued)

(51) Int. Cl.
*E04F 15/02* (2006.01)
*E04B 1/00* (2006.01)

(52) U.S. Cl.
CPC ..... *E04F 15/02194* (2013.01); *E04B 1/003* (2013.01); *E04F 15/02183* (2013.01)

(58) Field of Classification Search
CPC ..... E04F 15/02183; E04F 15/02194; E04B 1/003; E01C 5/001; E01C 5/223
See application file for complete search history.

(56) References Cited

U.S. PATENT DOCUMENTS 2,003,996 A 6/1935 Finzer et al.
2,103,569 A 12/1937 Wallace et al.
(Continued)

FOREIGN PATENT DOCUMENTS

AU 2020203897 A1 1/2021
AU 2020203907 A1 1/2021
(Continued)

OTHER PUBLICATIONS

"Duralife Decking Installation Using the Step-Clip Fastening System" video posted by DuraLife by Barrette Outdoor Living on Dec. 8, 2017, Retrieved from: https://www.youtube.com/watch?v=hhxfNsoJCWw Transcript retrieved on: Aug. 1, 2022 (9 pages total).
(Continued)

*Primary Examiner* — Theodore V Adamos
(74) *Attorney, Agent, or Firm* — John Maldjian, Esq.; Stevens & Lee PC

(57) ABSTRACT

A deck tile assembly is disclosed. The deck tile assembly comprises a frame having at least four sides. The deck tile assembly further comprises a plurality of bars for providing a support structure to the frame. The deck tile assembly further comprises at least two parallel sleepers permanently attached between two opposite sides of the frame and mounted on the plurality of bars. The deck tile assembly further comprises at least two step clip fastening devices, wherein each of the step clip fastening device is mounted on one of the at least two parallel sleepers. The deck tile assembly further comprises at least two supporting members for attaching the frame with the ground surface.

18 Claims, 33 Drawing Sheets

Related U.S. Application Data continuation of application No. 17/487,080, filed on Sep. 28, 2021, now Pat. No. 11,719,004, which is a continuation of application No. 16/788,378, filed on Feb. 12, 2020, now Pat. No. 11,156,005.

(60) Provisional application No. 62/866,152, filed on Jun. 25, 2019.

(56) References Cited

U.S. PATENT DOCUMENTS 2,832,102 A 4/1958 Amoruso
D195,504 S 6/1963 Walte
3,197,934 A 8/1965 Brown
3,253,377 A 5/1966 Schakel
D205,891 S 10/1966 Feliziani
3,321,883 A 5/1967 Pascucci
3,472,118 A 10/1969 Jureit
D222,895 S 1/1972 Zampetti et al.
3,807,675 A 4/1974 Seckerson et al.
D250,847 S 1/1979 Lemieux
4,209,043 A 6/1980 Menzel
4,226,064 A 10/1980 Kraayenhof
4,700,527 A 10/1987 Pardo
4,807,412 A 2/1989 Frederiksen
5,067,677 A 11/1991 Miceli
D326,999 S 6/1992 Johnson et al.
5,323,575 A 6/1994 Yeh
5,390,457 A 2/1995 Sjoelander
5,390,462 A 2/1995 Kreiter
D365,007 S 12/1995 Sheftel
D379,427 S 5/1997 Laga
5,628,160 A * 5/1997 Kung ..... E01C 13/045 52/177
5,827,441 A 10/1998 Solbjoerg
D404,504 S 1/1999 Dickey
D415,408 S 10/1999 Wizikowski, Sr.
D415,913 S 11/1999 Ernst
D427,048 S 6/2000 Potter et al.
D438,650 S 3/2001 Neuhofer, Jr.
D462,665 S 9/2002 Witting
6,694,691 B2 2/2004 Ku
D518,616 S 4/2006 Goodwin
7,114,298 B2 10/2006 Kotler
D552,269 S 10/2007 Vibiano et al.
D561,102 S 2/2008 Taneno et al.
D568,254 S 5/2008 Patchett et al.
7,543,417 B2 6/2009 Mcintosh et al.
D597,493 S 8/2009 Wu
D600,366 S 9/2009 Boardman
D609,373 S 2/2010 Curtas
D621,076 S 8/2010 Vibiano
7,793,470 B1 9/2010 Mathiesen et al.
7,975,728 B2 7/2011 Melville et al.
D656,006 S 3/2012 Underkofler et al.
8,146,303 B2 4/2012 Gibson et al.
8,186,116 B2 5/2012 Anderson
8,205,407 B2 6/2012 Genova
D663,045 S 7/2012 Ryan
8,230,654 B2 7/2012 Mcintosh et al.
8,266,857 B2 9/2012 David
D681,438 S 5/2013 Chen
8,539,727 B2 9/2013 Lui
8,561,356 B2 10/2013 Chuang
8,973,326 B2 3/2015 Lenoci
D728,349 S 5/2015 Lake
9,038,341 B2 5/2015 Lam et al.
D733,933 S 7/2015 Lee et al.
9,181,716 B1 11/2015 Gibson
D750,282 S 2/2016 Lippeatt
9,309,677 B1 4/2016 Anic
D755,043 S 5/2016 Bailey
9,416,546 B2 8/2016 Claudin et al.
9,458,635 B1 10/2016 Anic
9,499,979 B2 11/2016 Huang et al.
9,528,277 B2 12/2016 Prati et al.
9,593,490 B2 3/2017 Anic
D788,947 S 6/2017 Gilkey et al.
9,869,096 B2 1/2018 Brochu et al.
D824,755 S 8/2018 Bauer et al.
10,472,111 B2 11/2019 Li
10,472,817 B2 11/2019 Harnish et al.
10,487,460 B2 11/2019 Lee
D893,289 S 8/2020 Oetlinger et al.
D893,875 S 8/2020 Hsieh
10,781,595 B2 9/2020 Mcintosh et al.
D902,023 S 11/2020 Briese
D902,684 S 11/2020 Barraco
10,842,303 B1 11/2020 Vieveen
D905,286 S 12/2020 Hay, III
10,889,994 B1 1/2021 Schneider
10,941,577 B1 3/2021 Bennett et al.
D922,186 S 6/2021 Schneider et al.
11,105,100 B2 8/2021 Schneider
11,156,005 B2 10/2021 Schneider et al.
11,454,032 B2 9/2022 Schneider
11,719,004 B2 8/2023 Schneider et al.
11,746,533 B2 9/2023 Schneider
2003/0136070 A1 7/2003 Ku
2003/0177728 A1 9/2003 Ku
2005/0034395 A1 2/2005 Kotler
2005/0034403 A1 2/2005 Chen
2006/0185297 A1 8/2006 Mei
2006/0283125 A1* 12/2006 Moller ..... E01C 13/045 52/578
2007/0094969 A1 5/2007 Mcintosh et al.
2008/0313987 A1 12/2008 Ibanez et al.
2009/0266022 A1 10/2009 Lin
2010/0146900 A1 6/2010 Holland
2010/0257801 A1 10/2010 Anderson
2010/0263317 A1 10/2010 Genova
2010/0313509 A1 12/2010 Mcintosh et al.
2011/0120037 A1* 5/2011 Barlow ..... E04F 15/105 52/309.1
2011/0289875 A1* 12/2011 Lenoci ..... E04F 15/043 52/302.1
2012/0117910 A1* 5/2012 Chuang ..... A47B 96/20 52/588.1
2015/0059271 A1 3/2015 Tsai
2015/0096250 A1* 4/2015 Lam ..... E04F 15/02194 52/403.1
2015/0292217 A1 10/2015 Prati et al.
2017/0226752 A1 8/2017 Tsai
2017/0298638 A1 10/2017 Bosman
2018/0194502 A1 7/2018 Li
2019/0010710 A1 1/2019 Choy
2020/0232227 A1 7/2020 Mcintosh et al.
2020/0340256 A1 10/2020 Lee et al.
2020/0407982 A1 12/2020 Schneider et al.
2021/0164235 A1 6/2021 Schneider
2022/0136254 A1 5/2022 Schneider
2023/0183983 A1 6/2023 Schneider
2023/0399854 A1 12/2023 Schneider

FOREIGN PATENT DOCUMENTS

CA 191110 A 6/1919
CA 3072633 A1 12/2020
CA 3084539 A1 12/2020
CA 3084539 C 12/2022
FR 2989713 A1 * 10/2013 ..... E04F 15/02183
JP 2001182056 A * 7/2001
KR 101907111 B 10/2018
NZ 765671 A2 5/2024
WO 2010079462 A1 7/2010
WO WO-2016097303 A1 * 6/2016 ..... E04F 15/043

OTHER PUBLICATIONS

"Duralife Step-Clip Demonstration" from the 2018 Erie Materials Contractor Expo, video posted by DuraLife by Barrette Outdoor Living on Mar. 30, 2018, Retrieved from: https://www.youtube.

(56) References Cited

OTHER PUBLICATIONS com/watch?v=VNvNj-J4iql Transcript retrieved on: Aug. 1, 2022 (5 pages total).
"DuraLife Step-Clip Time Study" video posted by DuraLife by Barrette Outdoor Living on Oct. 12, 2017, Retrieved from: https://www.youtube.com/watch?v=2loA0CFN3wl Transcript retrieved on: Aug. 1, 2022 (2 pages total).
"Step Clip for Kebony with Brian Gurry, USA" video posted by Kebony Wood on Jun. 4, 2019, Retrieved from: https://www.youtube.com/watch?v=WKGqnIPM2ec Transcript retrieved on: Aug. 1, 2022 (7 pages total).
Canadian Requisition dated May 8, 2023 in connection with corresponding Canadian Application No. 3,072,633 (5 pages total).
DuraLife by Barrette Outdoor Living, "It's a SNAP with Step-Clip", Facebook, Oct. 12, 2017, 3 minutes, Retrieved from: https://www.facebook.com/DuraLifeDecking/videos/1472933289463502/ Images from post retrieved on Aug. 1, 2022 (5 pages total).
First Australian Examination Report dated Feb. 3, 2021 issued in connection with corresponding Australian Patent Application No. 2020203897 (5 pages total).
First Australian Examination Report dated Mar. 17, 2021 issued in connection with corresponding Australian Patent Application No. 2020203907 (10 pages total).
Machine translation of foreign reference FR2989713, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2989713&SRCLANG=fr&TRGLANG=en (last accessed on Feb. 19, 2021) (Year: 2021).
Second Australian Examination Report dated Jun. 22, 2021 in connection with corresponding Australian Patent Application No. 2020203907 (4 pages total).
Canadian Office action dated Oct. 23, 2025 in corresponding Canadian application No. 3,222,882, 5 pages.

* cited by examiner

SYSTEM AND METHOD FOR DECKING TILES

CROSS-REFERENCE TO RELATED APPLICATIONS

This application is a continuation-in-part of U.S. application Ser. No. 18/210,707 filed on Jun. 16, 2023, entitled, "System and Method for Decking Tiles," which is a continuation of U.S. application Ser. No. 17/487,080 filed Sep. 28, 2021, entitled, "System and Method for Decking Tiles", now U.S. Pat. No. 11,719,004, which is a continuation of U.S. application Ser. No. 16/788,378 filed Feb. 12, 2020, entitled, "System and Method for Decking Tiles", now U.S. Pat. No. 11,156,005, which claims the benefit of U.S. Provisional Application Ser. No. 62/866,152 filed Jun. 25, 2019, entitled "System and Method For Decking Tiles", which are incorporated herein by reference in their entirety.

BACKGROUND

Field

Embodiments of the present invention generally relate to a system and method for decking tiles, and particularly to a system and a method for decking tiles on ground surfaces.

Description of Related Art

Conventional deck tiles require joist beams or a wooden frame assembly for decking tiles on ground surfaces. In addition, these conventional deck tiles have pre-attached deck boards that are further placed on a structure such as, a roof top or a concrete patio. In case, the ground surface is uneven or irregular, then these conventional deck tiles use height adjustable support attachments, or the ground surface needs to be levelled up before installing the decking tiles. However, such attachments are made up of plastic and therefore, are not durable and robust enough to support deck boards for a long duration. Further, the deck boards may slip from the conventional deck tiles, which may cause the deck boards to slide out of an engagement in a horizontal direction. In order to eliminate the above problem, the deck boards has to be screwed down at each end of the deck to hold the deck boards by using fastening means such as, but not limited to, fasteners, nails, screws, and so forth. Gradually, the fastening means loosen up due to impact or vibrations generated by walking on the deck tiles, and as a result, a gap is formed between the deck boards. In addition, such fastening means can be hazardous to individuals walking on the deck boards, in case a head of a nail is raised above the deck board surface.

There is thus a need for a system and a method for arranging deck tiles in a matrix on uneven surfaces in a more efficient manner.

SUMMARY

Embodiments in accordance with the present invention provide a deck tile assembly. The deck tile assembly comprises a frame having at least four sides. The deck tile assembly further comprises a plurality of bars for providing a support structure to the frame. The deck tile assembly further comprises at least two parallel sleepers permanently attached between two opposite sides of the frame and mounted on the plurality of bars. The deck tile assembly further comprises at least two step clip fastening devices, wherein each of the step clip fastening device is mounted on one of the at least two parallel sleepers. The deck tile assembly further comprises hooking connectors that are positioned underneath the at least two step clip fastening devices. The hooking connectors are configured to enable the at least two step clip fastening devices to remained secured on the at least two parallel sleepers. The deck tile assembly further comprises at least two supporting members for attaching the frame with the ground surface. A stake is positioned through a cone-shaped through-hole to attach the frame with the ground surface.

Embodiments in accordance with the present invention provide a deck tile system. The deck tile system comprises a deck tile assembly, wherein the assembly comprises a frame having at least four sides. The deck tile assembly further comprises a plurality of bars for providing a support structure to the frame. The deck tile assembly further comprises at least two parallel sleepers permanently attached between two opposite sides of the frame and mounted on the plurality of bars. The deck tile assembly further comprises at least two step clip fastening devices, wherein each of the step clip fastening device is mounted on one of the at least two parallel sleepers. The deck tile assembly further comprises at least two supporting members for attaching the frame with the ground surface. The at least two stakes are positioned at an angle to attach the frame to the ground surface. The deck tile system further comprises a plurality of deck boards attached to the deck tile assembly, wherein each of the plurality of deck boards are mounted between two step clips of each of the at least two step clip fastening devices. The deck tile system further comprises at least one hooking connector positioned on each tile, and positioned beneath the plurality of deck boards.

Embodiments in accordance with the present invention provide a method of assembling at least two deck tile assemblies. The method comprising the steps of placing a first deck tile assembly on a ground surface; placing a second deck tile assembly adjacent to the first deck tile assembly; aligning a plurality of grooves of the first deck tile assembly with a plurality of protrusions of the second deck tile assembly; aligning a plurality of protrusions of the first deck tile assembly with a plurality of grooves of the second deck tile assembly; snapping the second deck tile assembly with the first deck tile assembly; fastening the first deck tile assembly and the second deck tile assembly using a plurality of locking mechanisms, wherein the first deck tile assembly and the second deck tile assembly each contain a hooking connector; and attaching a plurality of skirting enclosing a periphery of the two assembled deck tile assemblies.

Embodiments in accordance with the present invention provide a deck tile assembly for installation of deck boards on uneven ground surfaces without much preparation such as, levelling the ground, etc.

Embodiments in accordance with the present invention include cone-shaped through holes that enable stakes to be placed at an angle into the ground surface, and more securely hold the deck tile assembly within the ground surface.

The present inventive features also include hooking connectors that secure each tile assembly to the adjacent tile assembly to ensure that the entire deck tile assembly remains secured and interconnected.

The deck tile assembly may be placed on a variety of surfaces and therefore, may be used as a sub-flooring on an uneven ground surface, on concrete or pavers, as the deck tile assembly is capable of being leveled even on uneven surfaces such as interlocking pavers, and the like.

The deck tile assembly may comprise a frame having corners that allow for self-leveling or leveling capabilities. In addition, the frame comprises openings for receiving uneven surfaces of the ground and therefore to provide an evenly levelled ground surface for installation of deck boards.

Embodiments in accordance with the present invention provide a deck tile assembly that may comprise a step clip fastening device within the frame of the deck tile assembly. The step clip fastening device includes a plurality of step clips along the length of the step clip fastening device. The step clips are designed to accommodate deck boards within its cavity when the deck boards are pressed against and into the step clips of the deck tile assembly.

According to an embodiment of the present invention, the step clips may comprise a rubber like material over-molded on an inner surface of the step clips to provide enough friction for the deck boards and thus, restricting the movement of the deck boards in the horizontal direction.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1A:
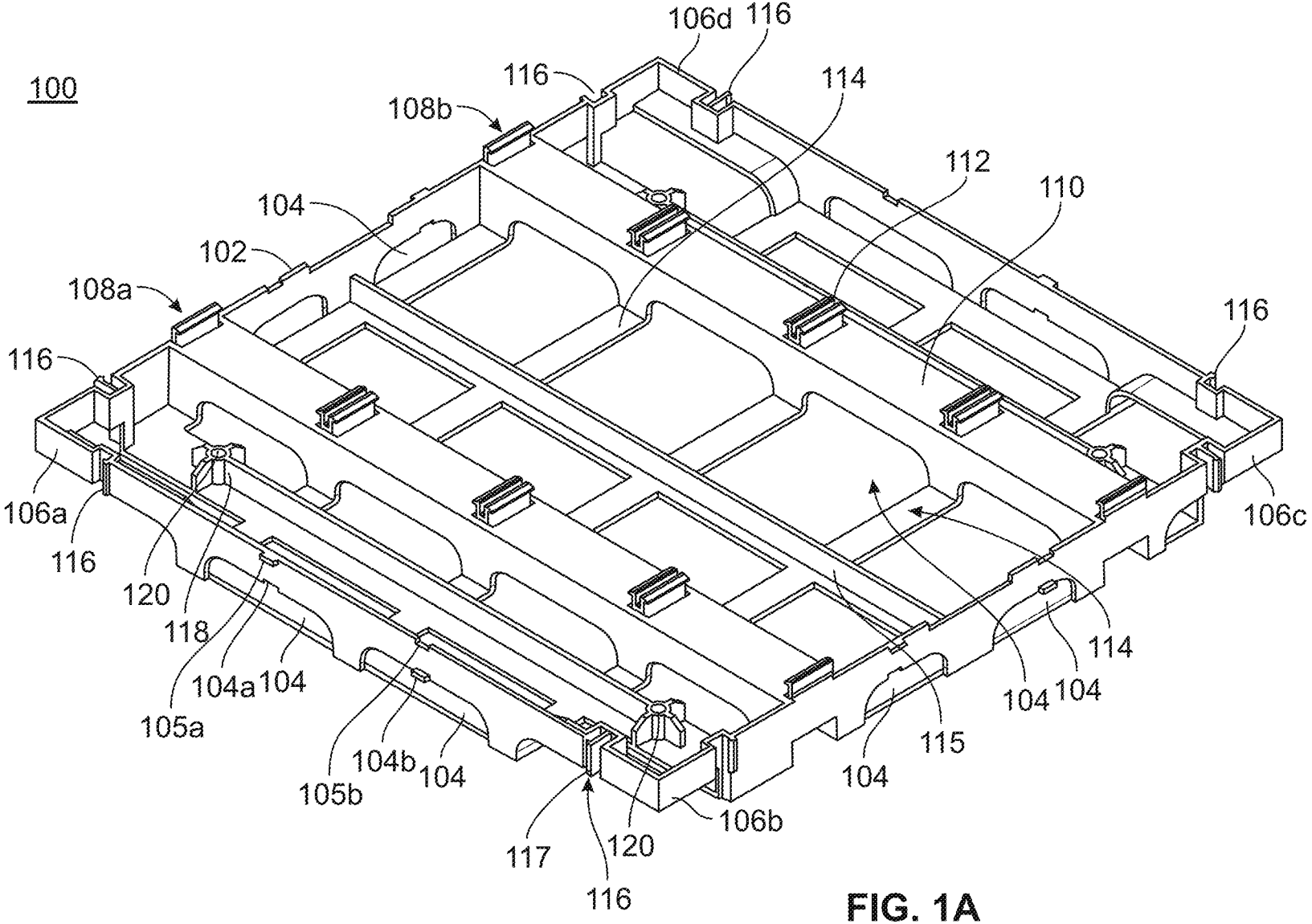
FIG. 1A illustrates a perspective view of a deck tile, according to an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

FIG. 1A illustrates a perspective view of a deck tile 100, according to an embodiment of the present invention. The deck tile 100 may be made up of, but not limited to, a metal, a wood, a plastic, or a combination thereof. Embodiments of the present invention are intended to include or otherwise cover any material that may be beneficial to provide a durable and robust structure to the deck tile 100. The deck tile 100 may comprise a frame 102. In an embodiment of the present invention, the frame 102 of the deck tile 100 may have four sides. Further, each side of the frame 102 may comprise openings 104, in an embodiment of the present invention. The opening 104 may be used for receiving uneven surfaces of a ground and therefore to provide an evenly levelled ground surface for the installation of deck boards, in an embodiment of the present invention. In another embodiment of the present invention, the opening 104 may provide required airflow and ventilation to prevent moisture buildup in the deck tile 100. In an embodiment of the present invention, the openings 104 may be present at a base of a surface of each side of the frame 102. In another embodiment of the present invention, the openings 104 may be present at the periphery of each side of the frame 102. The openings 104 may be present at an equal distance on the surface of each side of the frame 102, or on the periphery of the frame 102, in an embodiment of the present invention. In an embodiment of the present invention, the openings 104 may be in the shape of an arc, a square, a rectangle, and so forth. Embodiments of the present invention are intended to include or otherwise cover any shape and size of the openings 104 including known, related art, and/or later developed technologies that may be beneficial to receive uneven ground surfaces and to provide a levelled ground surface for installation of a deck even on uneven ground surfaces. In an embodiment of the present invention, one opening 104 of each side of the frame 102 may include a groove 104*a* and a protrusion 104*b* on a second opening 104 of the each side of the frame 102. In addition, corresponding to the groove 104*a*, a protrusion 105*a* may be provided on an edge of a surface of the side, which is located parallel to the groove 104*a*. The protrusion 105*a* and the groove 104*a* may provide a locking mechanism for locking a second deck tile with the deck tile 100. Similarly, corresponding to the protrusion 104*b*, a groove 105*b* may be provided on an edge of a surface of the side, which is located parallel to the protrusion 104*b*.

The frame 102 of the deck tile 100 may further comprise corners 106 such as corner 106*a*, 106*b*, 106*c*, and 106*d*. Each corner 106 of the frame 102 may allow for self-leveling or leveling capabilities with respect to the ground surface such as uneven ground surface. In an embodiment of the present invention, each corner 106 may be a L-shaped corner attached to two adjacent sides of the frame 102. In an embodiment of the present invention, a height of each corner is less than the height of each side of the frame 102. In an embodiment of the present invention, each corner 106 may be integrally attached to the two adjacent sides of the frame 102. In another embodiment of the present invention, each corner 106 may be removably attached to the two adjacent sides of the frame 102.

Further, the deck tile 100 may comprise at least two step clip fastening devices 108*a* and 108*b* (hereinafter referred to as a step clip fastening device 108), in an embodiment of the present invention. The step clip fastening device 108 may comprise a base strip 110, a plurality of step clips 112, and a tab (not shown). The base strip 110 is preferably made up of glass filled polypropylene, in an embodiment of the present invention. Embodiments of the present invention are intended to include or otherwise cover any material of the base strip 110 including known, related art, and/or later developed technologies that may be beneficial to provide dimensional stability, rigidity and strength to the base strip 110.

In an embodiment of the present invention, the step clips 112 are present along a length of the base strip 110. The step clip 112 is designed such that the step clip 112 may accommodate and hold a deck board (see FIGS. 26A-26B) within its cavity when the deck board is snapped in the step clip 112. The step clip 112 may be made up of glass filled polypropylene, in an embodiment of the present invention. Embodiments of the present invention are intended to include or otherwise cover any material of the step clip 112 including known, related art, and/or later developed technologies that may be beneficial to provide dimensional stability, rigidity and strength to the step clip 112.

According to an embodiment of the present invention, the step clip fastening device 108 comprises a tab (not shown) that extends vertically downwards from the base of the base strip 110. The tab may be used to align the step clip fastening device 108 on the frame 102 of the deck tile 100. The tab may be an arc head shaped, which may be used to align the step clip fastening device 108 on the base of the frame 102, in an embodiment of the present invention. In another embodiment of the present invention, the tab may be, but not limited to, an arc shaped, an oval head shaped, a circular head shaped, and so forth. In an embodiment of the present invention, the step clip fastening device 108 including the step clip 112, tab and base strip 110, may be a single piece molded over the base of the frame 102. In another embodiment of the present invention, the step clip fastening device 108 may be attached as a separate piece to the deck tile 100. In an embodiment of the present invention, each step clip 112 may include an anchor (not shown) protruded at its center on an inner cavity of the step clip 112. The anchor may provide enough friction to deck boards and therefore, restricts movement of deck boards in the horizontal direction. In an embodiment of the present invention, the anchor may be made up of a metal piece such as, but not limited to, stainless steel. In another embodiment of the present invention, the anchor may be made up of a rubber, over-molded on the inner cavity of each step clip 112. Embodiments of the present invention are intended to include or otherwise cover any type of material of the anchor including known, related art, and/or later developed technologies that may be beneficial to provide friction to the deck boards to restrict their movement in the horizontal direction. In an embodiment of the present invention, the anchor may be removably attached to the inner cavity of each step clip 112. In yet another embodiment of the present invention, the anchor may be permanently attached to the inner cavity of each step clip 112.

Further, the deck tile 100 may comprise bars 114 to provide a support system to the frame 102, in an embodiment of the present invention. In an embodiment of the present invention, the bars 114 may be vertical bars, horizontal bars, or a combination thereof. In an embodiment of the present invention, the bars 114 may be installed in a 3×3 matrix array. Embodiments of the present invention are intended to include or otherwise cover any configuration of a matrix array including known, related art, and/or later developed technologies that may be beneficial to provide a support structure to the frame 102. A gap between the vertical bars and the horizontal bars are openings, such as the openings 104.

The frame 102 of the deck tile 100 may include a support 115 between two opposite sides of the frame 102. The height of the support 115 may be less than the height of each side of the frame 102, in an embodiment of the present invention. In an embodiment of the present invention, the support 115 may be attached on one of the bars 114 by using a horizontal support structure, as shown in FIG. 2.

The deck tile 100 may further comprises a plurality of locking mechanisms 116, 104, 105. The locking mechanism 116 may be used to attach and/or lock another deck tiles to the deck tile 100. In an embodiment of the present invention, each side of the frame 102 may comprise at least two locking mechanisms 116. Therefore, each deck tile 100 may comprise at least eight locking mechanisms 116 at the four sides of the deck tile 100. In an embodiment of the present invention, the locking mechanism 116 may be, but not limited to, an interlock mechanism. The locking mechanism 116 may have a groove that fits in a groove of a locking mechanism of a second deck tile in order to interlock the two deck tiles. In another embodiment of the present invention, the locking mechanism 116 may be a snap lock mechanism. Embodiments of the present invention are intended to include or otherwise cover any type of locking mechanism including known, related art, and/or later developed technologies that may be beneficial to lock another deck tile or any other attachment. The locking mechanism 116 may be shaped as a groove having a lever 117 at a center of the groove, which is protruded outwards from the groove of the locking mechanism 116. In an embodiment of the present invention, the lever 117 may have a notch at a distal end of the lever 117. The shape of the notch may be a V-shaped notch, in an embodiment of the present invention. In another embodiment of the present invention, the notch may be round in shape. In an embodiment of the present invention, the lever 117 and the notch may be made up of a flexible material in order to interlock with a locking mechanism of another deck tile.

Further, the deck tile 100 may comprise a supporting member 118 that may be used to provide a support to deck boards when placed on the deck tile 100, in an embodiment of the present invention. Further, the supporting member 118 may comprise a hole 120 at each end of the supporting member 118. In an embodiment of the present invention, the hole 120 may be used to fix the deck tile 100 on the ground surface by using fastening means. In an embodiment of the present invention, the fastening means may include, but not limited to, fasteners, nails, nuts, screws, pins, and so forth. In an embodiment of the present invention, the holes 120 may pass through the bars 114 of the deck tile 100 in order to fix the deck tile 100 on the ground surface.

Figure 1B:
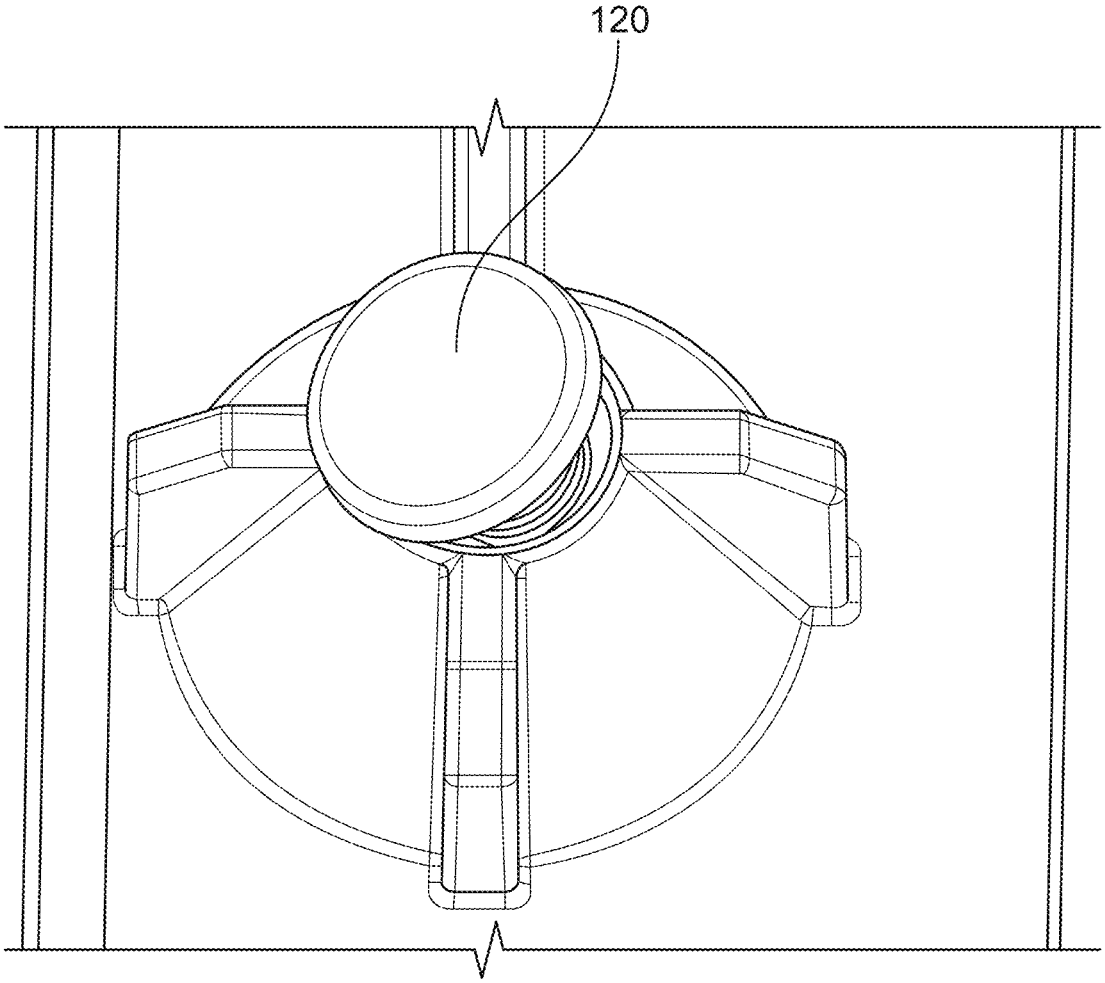
FIG. 1B illustrates a top view of a deck tile with a through-hole according to an embodiment of the invention.

Referring to FIG. 1B, in another illustrative embodiment, illustrates another version of the hole 120. The hole 120 will be cone shaped in other illustrated embodiments. The cone-shaped hole 120 is configured to enable stakes to be positioned within each of the cone shaped holes 120. The cone shape of each hole 120 will allow the stake to be placed at an angle through the hole 120. When each stake is placed at an angle through the corresponding hole 120, the stake is able to ensure that the deck tile 100 remains secure within the ground surface. There is less possibility from the deck tile 100 to be moved away from the ground surface when the stake is positioned at an angled position within the corresponding cone shaped hole 120. The cone shaped hole 120 in various embodiments will more securely position the deck tile 100 within the ground surface.

Figure 1C:
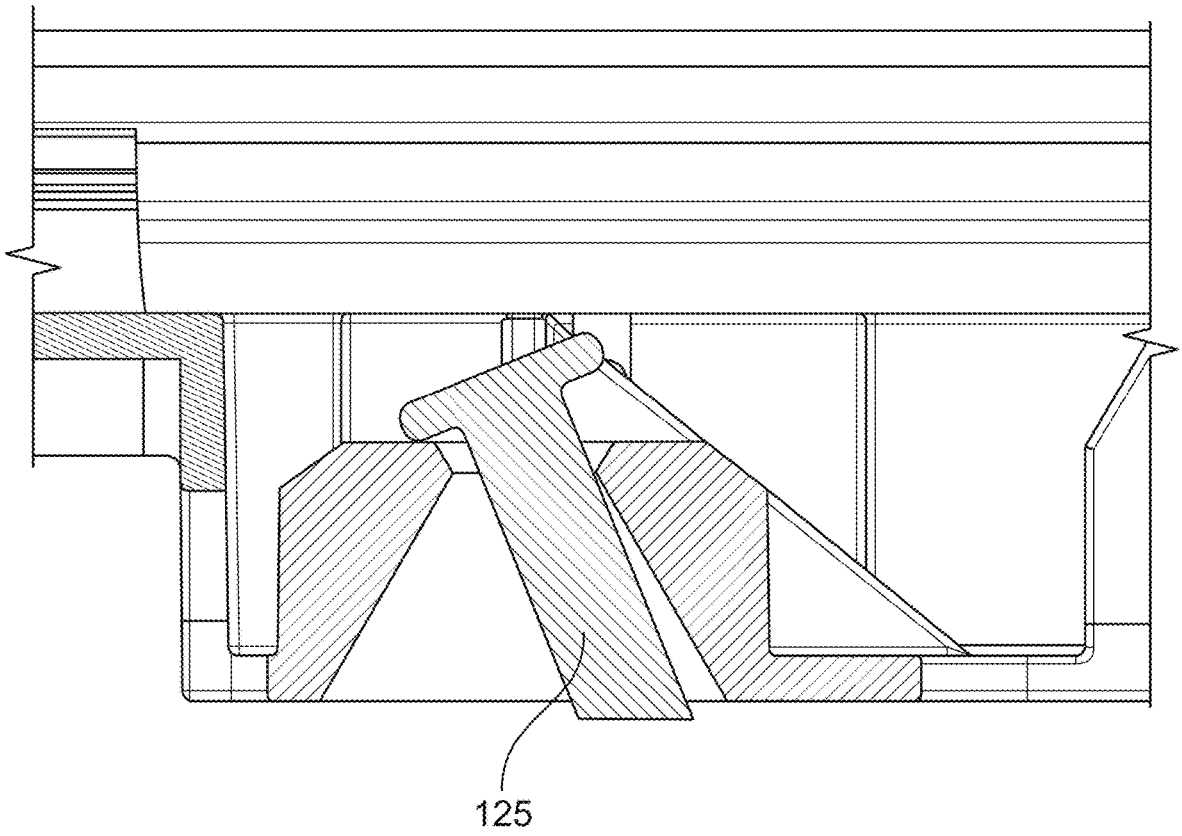
FIG. 1C illustrates a stake being placed through the through-hole according to an embodiment of the invention.

Referring to FIG. 1C, a stake 125 is shown securing a portion of the deck tile 100 into the ground surface. The stake 125 is positioned through a respective cone shaped hole 120. In such embodiments, the stake 125 being positioned at an angle will provide further securing for the deck tile 100. The angled position of each stake 125 through each cone shaped hole 120 will enable the various portions of the deck tile 100 to remain secured within the ground surface.

Figure 1D:
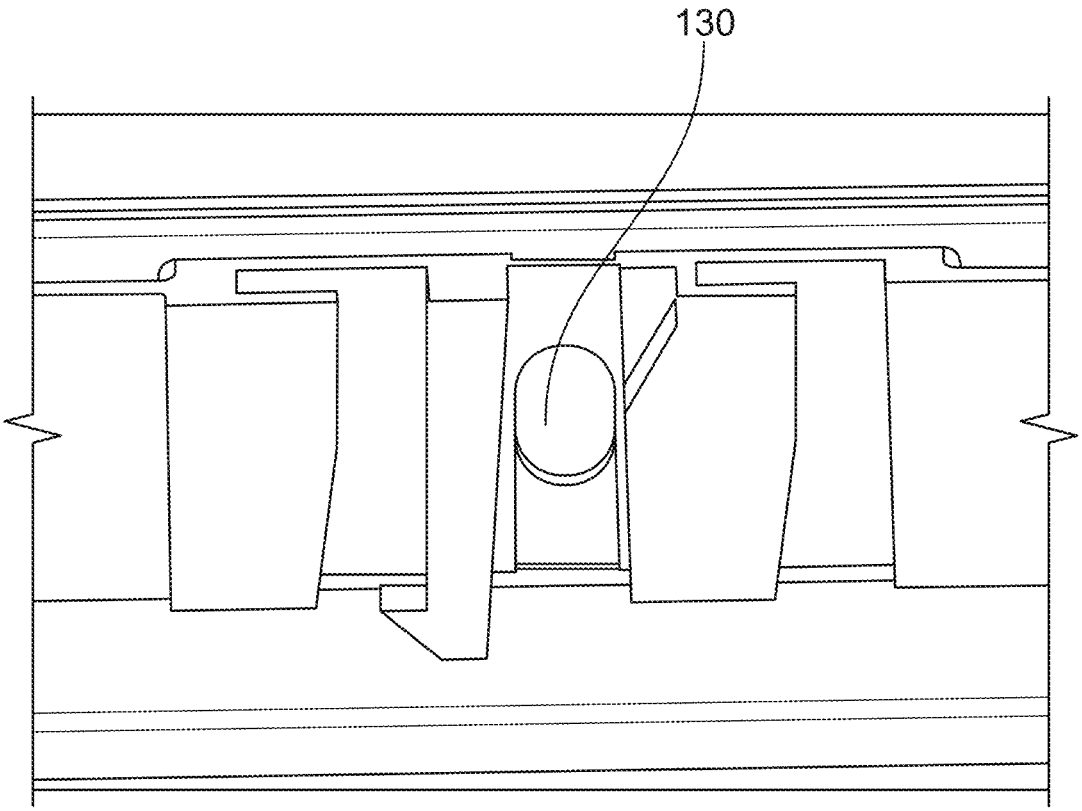
FIG. 1D illustrates a screw hole used within the tiles according to an embodiment of the invention.

In FIG. 1D, another illustrated embodiment of the deck tile 100 is shown. In various embodiments, portions of the deck tiles will have screw holes 130 to further secure each tile in place. Each screw hole 130 will also further secure each portion of the deck tile 100 in place over the ground surface.

Figure 2A:
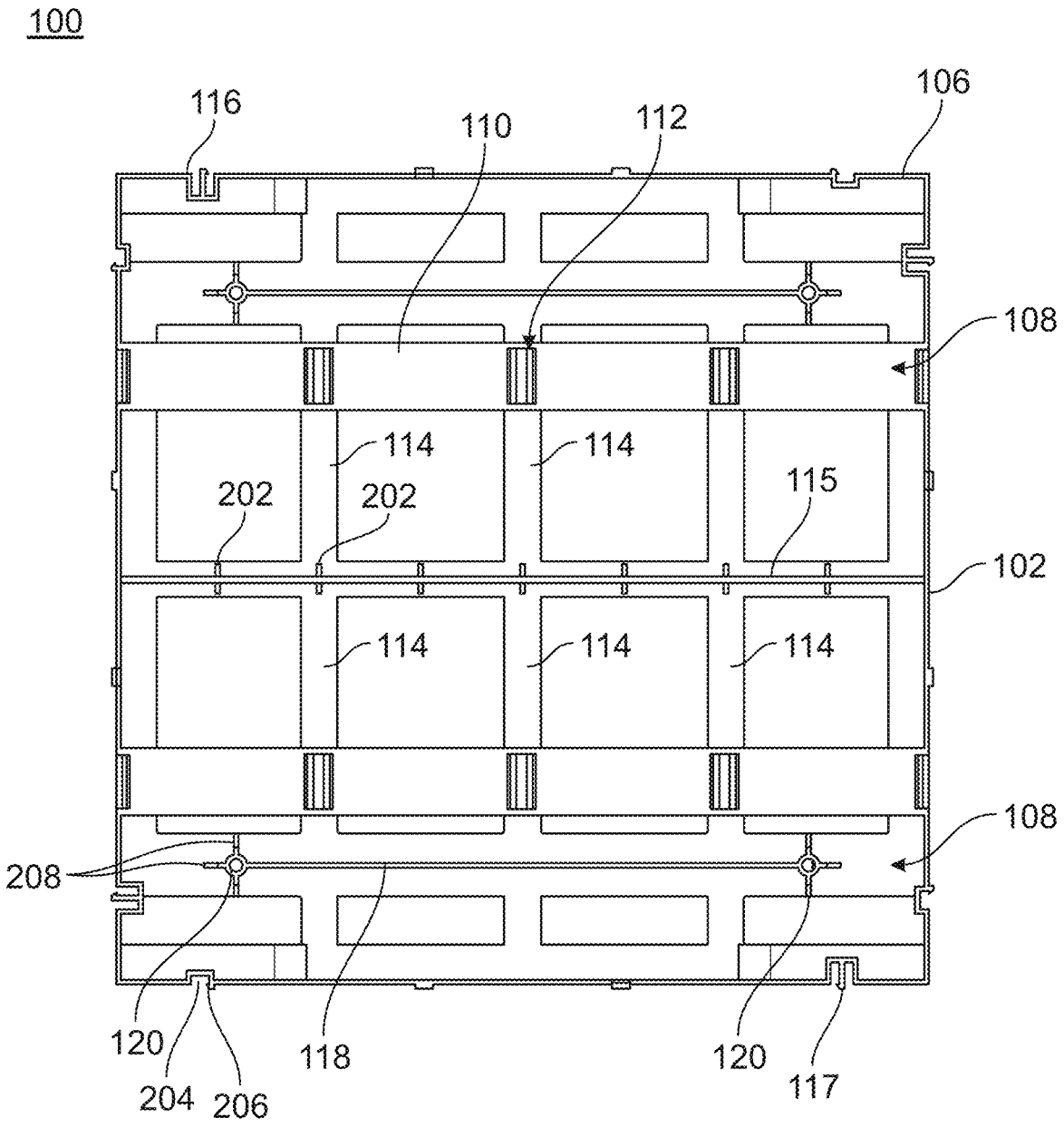
FIG. 2A illustrates a top view of the deck tile, according to an embodiment of the present invention.

FIG. 2A illustrates a top view of the deck tile 100, according to an embodiment of the present invention. As discussed above, the deck tile 100 may include the frame 102, the corners 106, and the step clip fastening devices 108. The step clip fastening devices 108 comprises the base strip 110 and the step clips 112.

Further, the deck tile 100 comprises the bars 114 for providing a support structure to the frame 102. The frame 102 of the deck tile 100 may include the support 115 between two opposite sides of the frame 102. The height of the support 115 may be less than the height of each side of the frame 102, in an embodiment of the present invention. In an embodiment of the present invention, the support 115 may be attached to one of the bars 114 by using horizontal support structures 202. The horizontal support structures 202 may be attached to the frame 102 by using the fastening means, in an embodiment of the present invention. In another embodiment of the present invention, the horizontal support structures 202 may be integrally attached to the frame 102.

The locking mechanism 116 may be used to attach and/or lock another deck tiles to the deck tile 100, in an embodiment of the present invention. Each side of the frame 102 may comprise at least two locking mechanisms 116. One of the locking mechanisms 116 may have a groove and a lever 117, as discussed above. The other locking mechanism 116 may be a groove 204 without a lever. One side of the groove of the other locking mechanism 116 may have a notch 206 for interlocking another deck tile to the deck tile 100.

Further, the supporting member 118 may be used to fix the deck tile 100 with a ground surface. In an embodiment of the present invention, the supporting member 118 may comprise the hole 120 at each end of the supporting member 118. Each of the hole 120 may be surrounded by a number of arms 208.

Figure 2B:
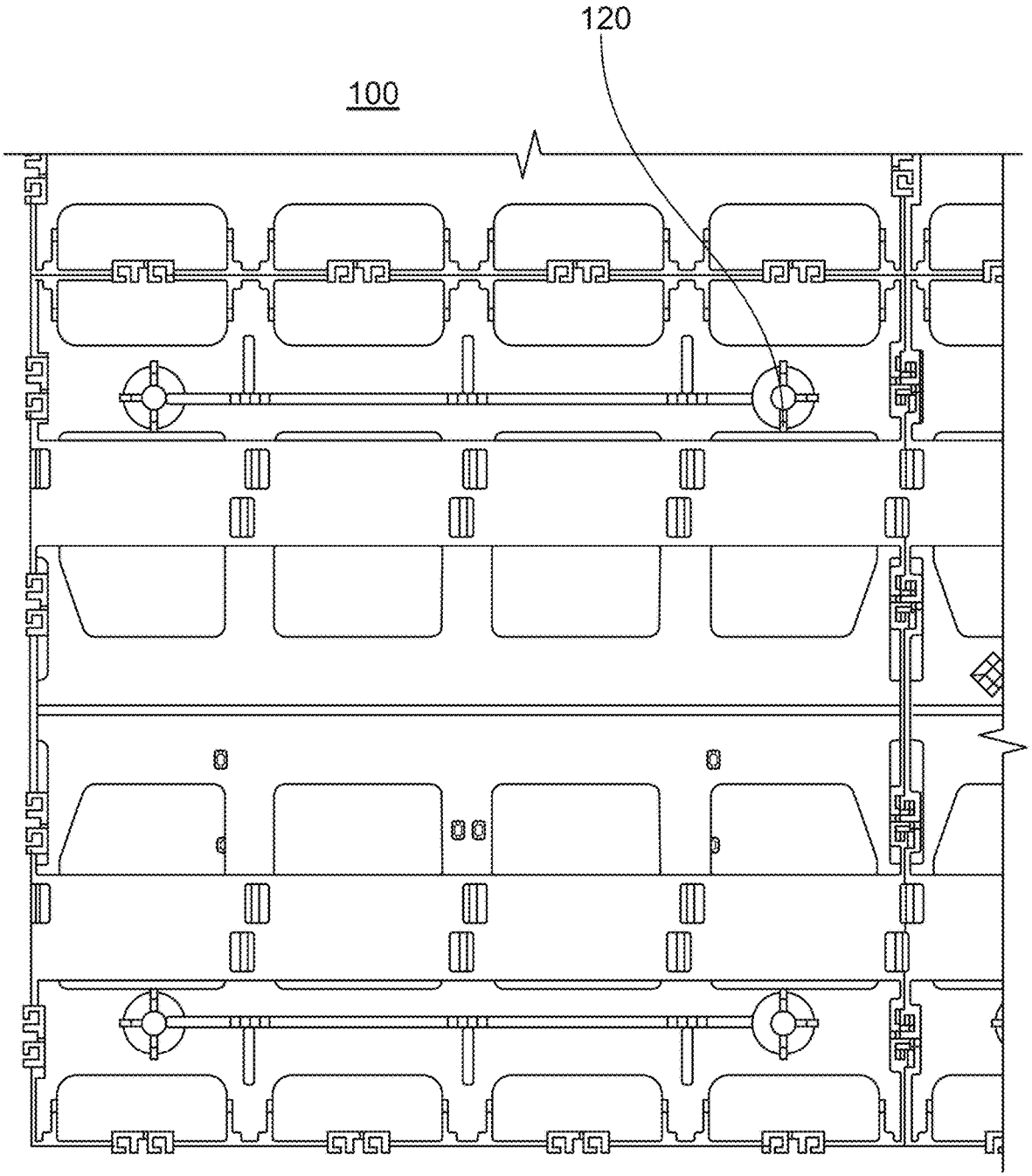
FIG. 2B illustrates a top view of tile connections according to an embodiment of the present invention.

FIG. 2B illustrates another embodiment of the deck tile 100. The deck tile 100 in various other embodiments can have hooking connections on each tile to secure each portion of the deck tile 100. The hooking connections will ensure that each portion of the deck tile 100 remain securing in place. It will more securely lock each portion of the deck tile 100 in place. The hole 120 will be in cone-shaped hole in several illustrative embodiments.

Figure 2C:
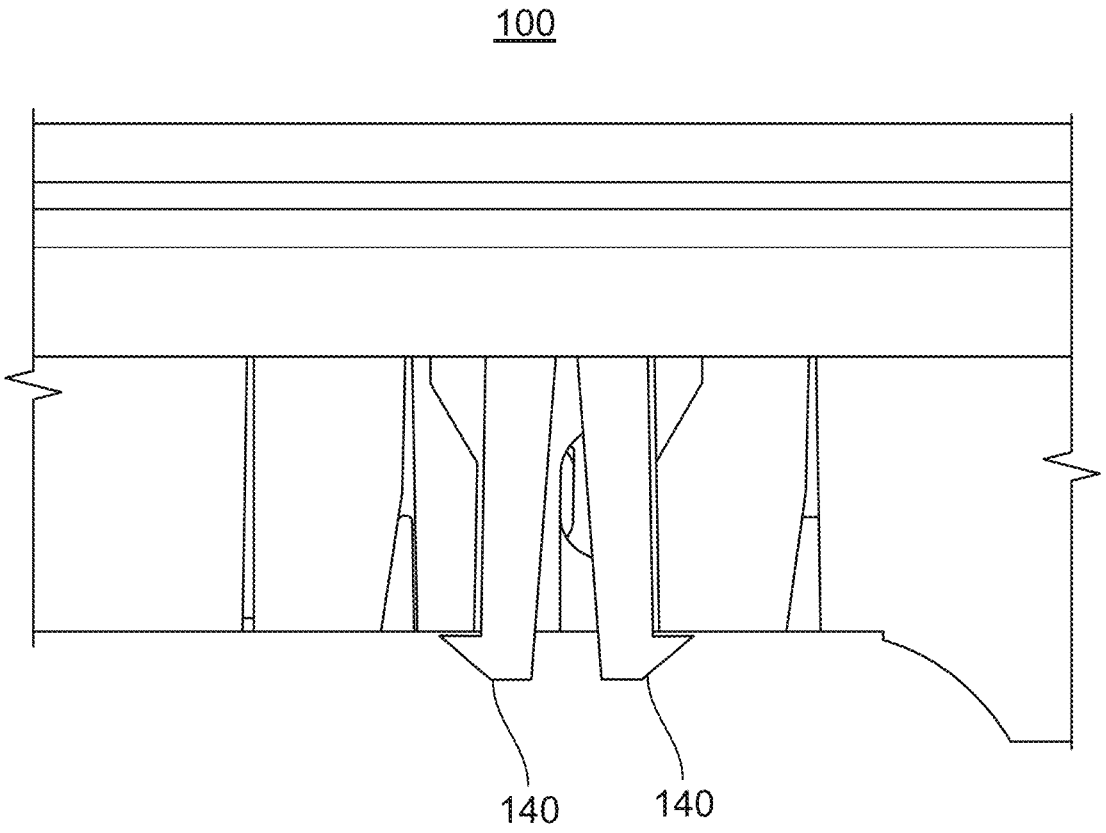
FIG. 2C illustrates hooking connectors according to an embodiment of the present invention.

Referring to FIG. 2C, hooking connectors 140 in an X section are shown on a portion of the deck tile 100. Moreover, hooking connectors 140 will be positioned on each portion of the deck tile 140 to ensure that the various portions of the deck tile 100 remain connected. The hooking connectors 140 will extend under the bottom portion of the deck tile 140. As opposed to the lever 117, the hooking connectors 140 will be positioned on various portions on and underneath the deck tile 100 to ensure that the various portions of the deck tile 100 do not fall apart and remain connected.

Figure 2D:
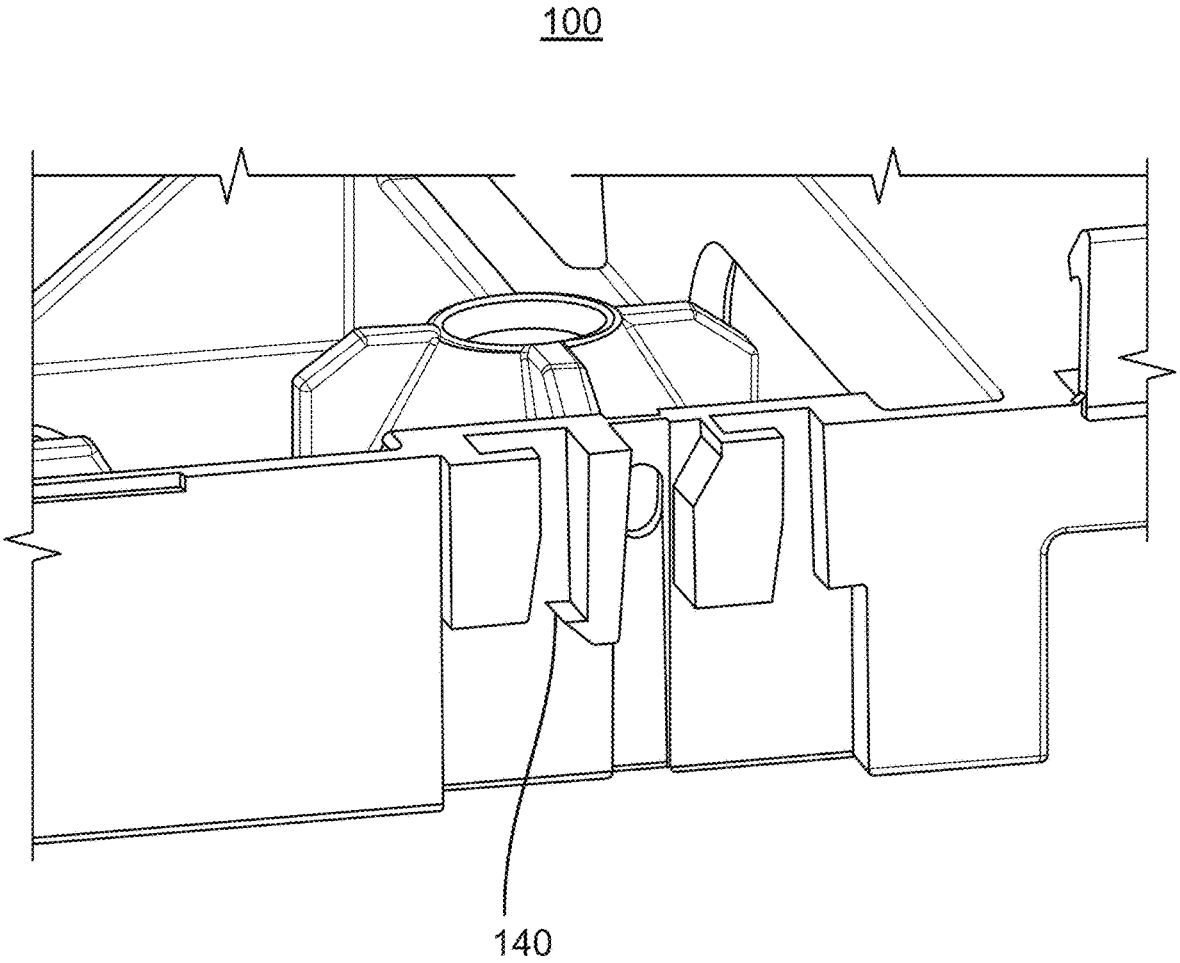
FIG. 2D illustrates a view of a hooking connector on each tile according to an embodiment of the present invention.

With respect to FIG. 2D, a connection on the deck tile 100 is shown. One hook of the hooking connectors 140 is shown to be configured on each tile of the deck tile 100.

Figure 3:
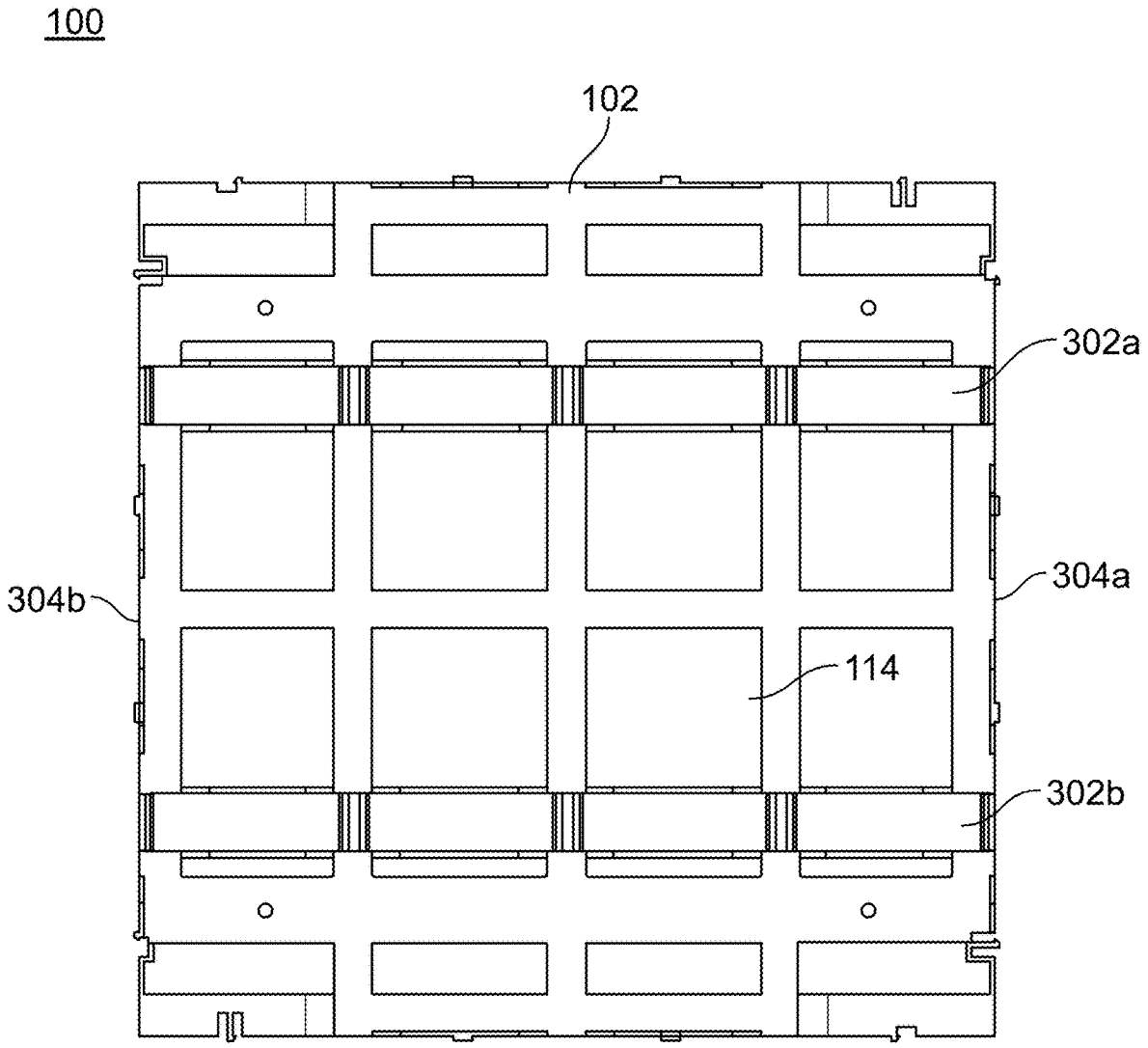
FIG. 3 illustrates a bottom view of the deck tile, according to an embodiment of the present invention.

FIG. 3 illustrates a bottom view of the deck tile 100, according to an embodiment of the present invention. The deck tile 100 comprises two parallel sleepers 302*a* and 302*b* (hereinafter referred to as a sleeper 302). The sleeper 302 may be permanently attached between two opposite sides 304*a* and 304*b* of the frame 102. In an embodiment of the present invention, the sleeper 302 may be mounted on the bars 114 of the deck tile 100. On each sleeper 302, one step clip fastening device 108 is mounted by using the tabs of the step clip fastening device 108, in an embodiment of the present invention.

Figure 4:
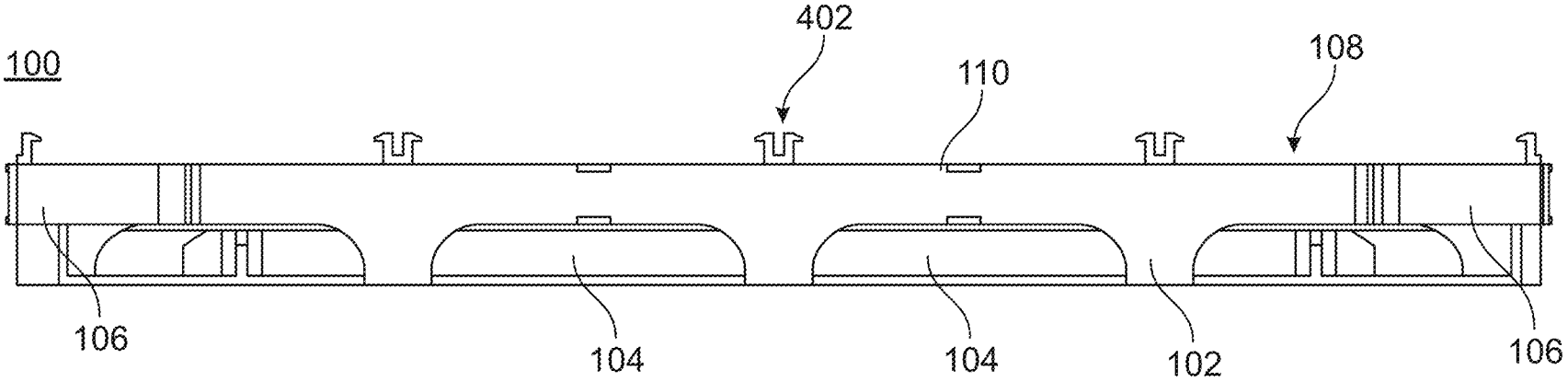
FIG. 4 illustrates a front view of the deck tile, according to an embodiment of the present invention.

FIG. 4 illustrates a front view of the deck tile 100, according to an embodiment of the present invention. The deck tile 100 comprises the step clip fastening device 108, as discussed in FIG. 1. The step clip fastening device 108 comprises the base strip 110 and step clips 112. When two step clips 112 are attached together facing opposite to each other, a step clip set 402 is formed. In an embodiment of the present invention, each step clip fastening device 108 may comprise three step clip sets and two step clips facing each other at the ends of the base strip 110. In an embodiment of the present invention, the length of the base strip 110 may be equal to the length of a side of the frame 102.

The deck tile 100 further comprises the openings 104 at each side of the frame 102. In an embodiment of the present invention, the openings 104 may be rectangular in shape having rounded corners. The openings 104 may be used to level the frame 102 with the ground surface, in an embodiment of the present invention. In another embodiment of the present invention, the openings 104 may provide airflow and ventilation to the deck tile 100.

Figure 5:
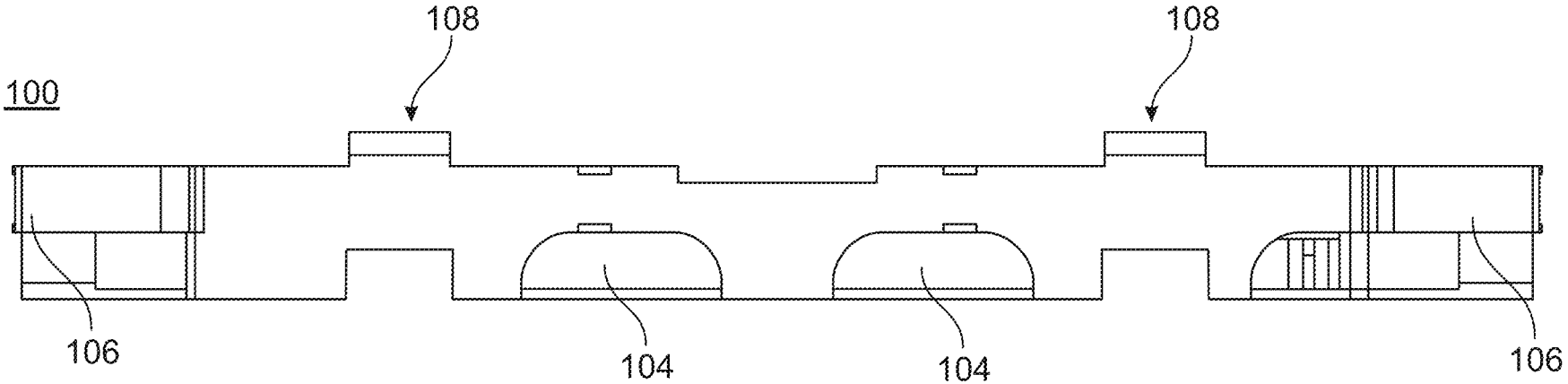
FIG. 5 illustrates a side view of the deck tile, according to an embodiment of the present invention.

FIG. 5 illustrates a side view of the deck tile 100, according to an embodiment of the present invention. Each side of the frame 102 comprises the openings 104. Further, the deck tile 100 comprises the corners 106. Furthermore, the deck tile 100 comprises the step clip fastening devices 108, as discussed above.

Figure 6:
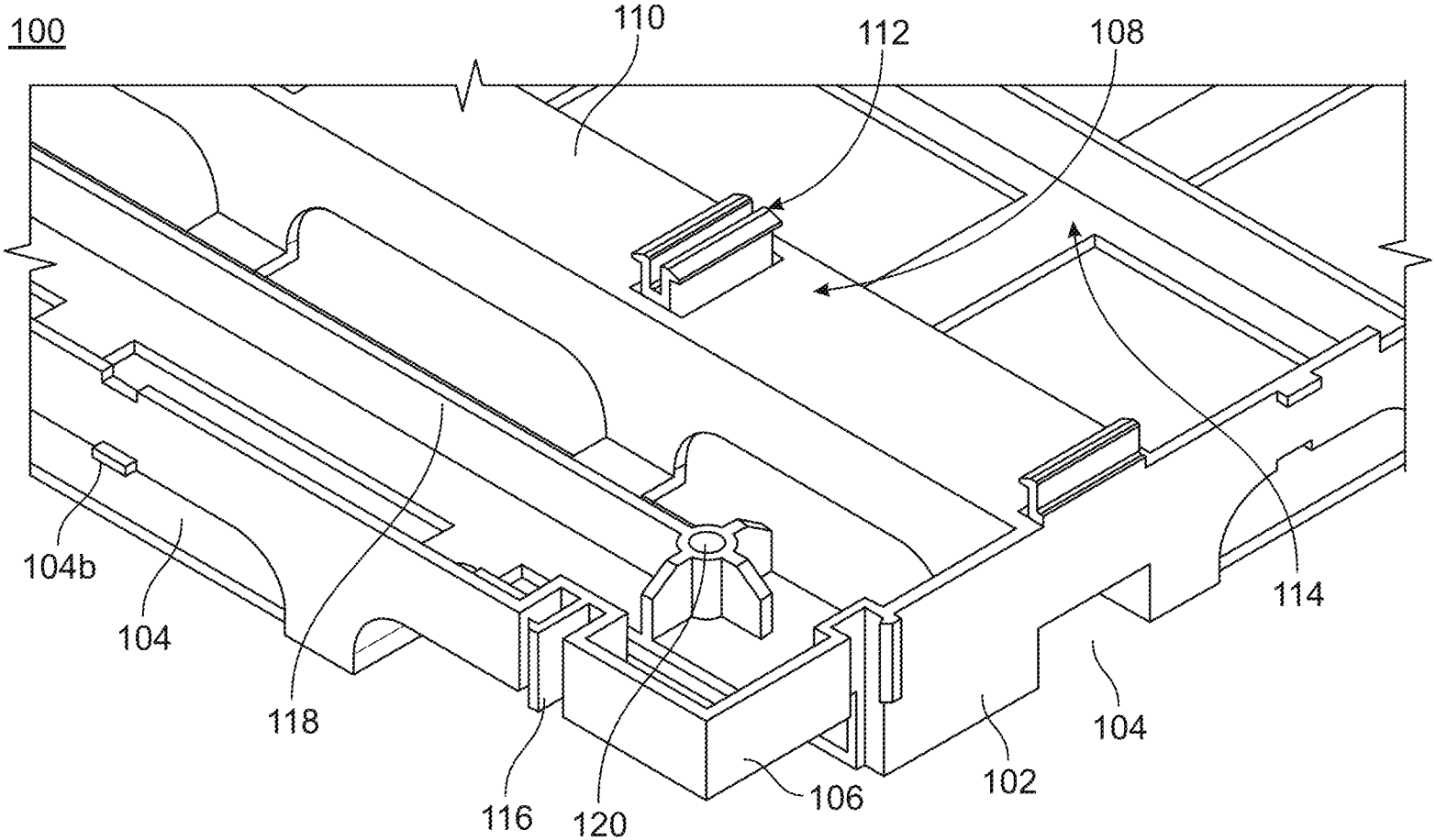
FIG. 6 illustrates an enlarged partial view of the deck tile, according to an embodiment of the present invention.

FIG. 6 illustrates an enlarged partial view of the deck tile 100, according to an embodiment of the present invention. The deck tile 100 may comprise the frame 102. In an embodiment of the present invention, the frame 102 of the deck tile 100 may have four sides. Further, each side of the frame 102 may comprise openings 104, in an embodiment of the present invention. The opening 104 may be used for receiving uneven surfaces of a ground and therefore to provide an evenly levelled ground surface for the installation of deck boards. The frame 102 of the deck tile 100 may further comprise corners 106 may allow for self-leveling or leveling capabilities with respect to the ground surface such as uneven ground surface. In an embodiment of the present invention, each corner 106 may be a L-shaped corner attached to two adjacent sides of the frame 102.

Further, the deck tile 100 may comprise at least two step clip fastening devices 108. The step clip fastening device 108 may comprise the base strip 110, a plurality of step clips 112, and a tab (not shown), in an embodiment of the present invention. The step clips 112 are present along the length of the base strip 110. Further, the deck tile 100 may comprise bars 114 to provide a support system to the frame 102, in an embodiment of the present invention.

The deck tile 100 may further comprise the locking mechanism 116. The locking mechanism 116 may be used to attach and/or lock another deck tiles to the deck tile 100. In an embodiment of the present invention, each side of the frame 102 may comprise at least two locking mechanisms 116. Further, the deck tile 100 may comprise the supporting member 118 that may be used to fix the deck tile 100 on the ground. In an embodiment of the present invention, a height of the supporting member 118 is less than the height of the side of the frame 102. In an embodiment of the present invention, the holes 120 passes through the bars 114 of the deck tile 100, as discussed above.

Figure 7:
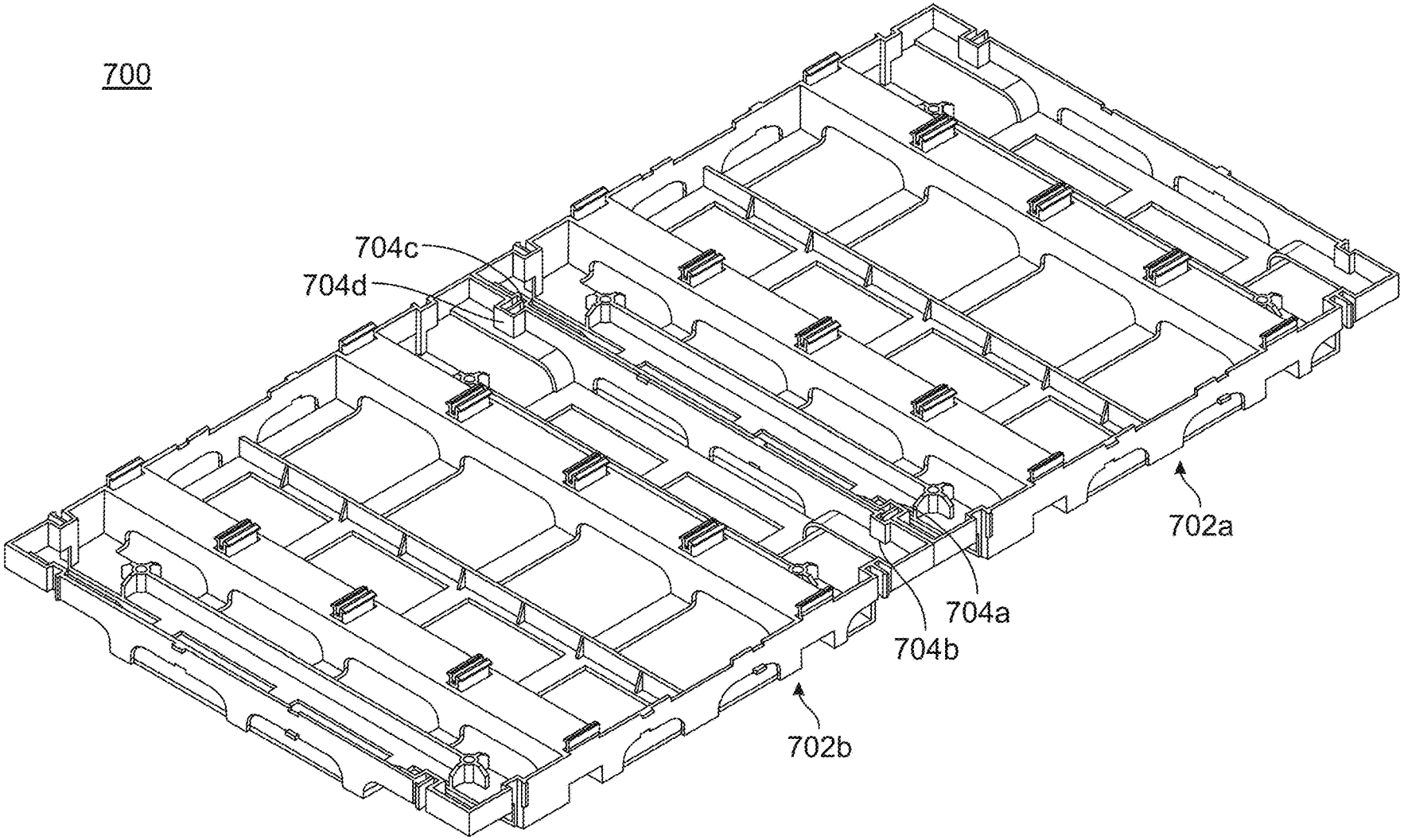
FIG. 7 illustrates a perspective view of two deck tiles interlocked via a locking mechanism, according to an embodiment of the present invention.
Figure 8:
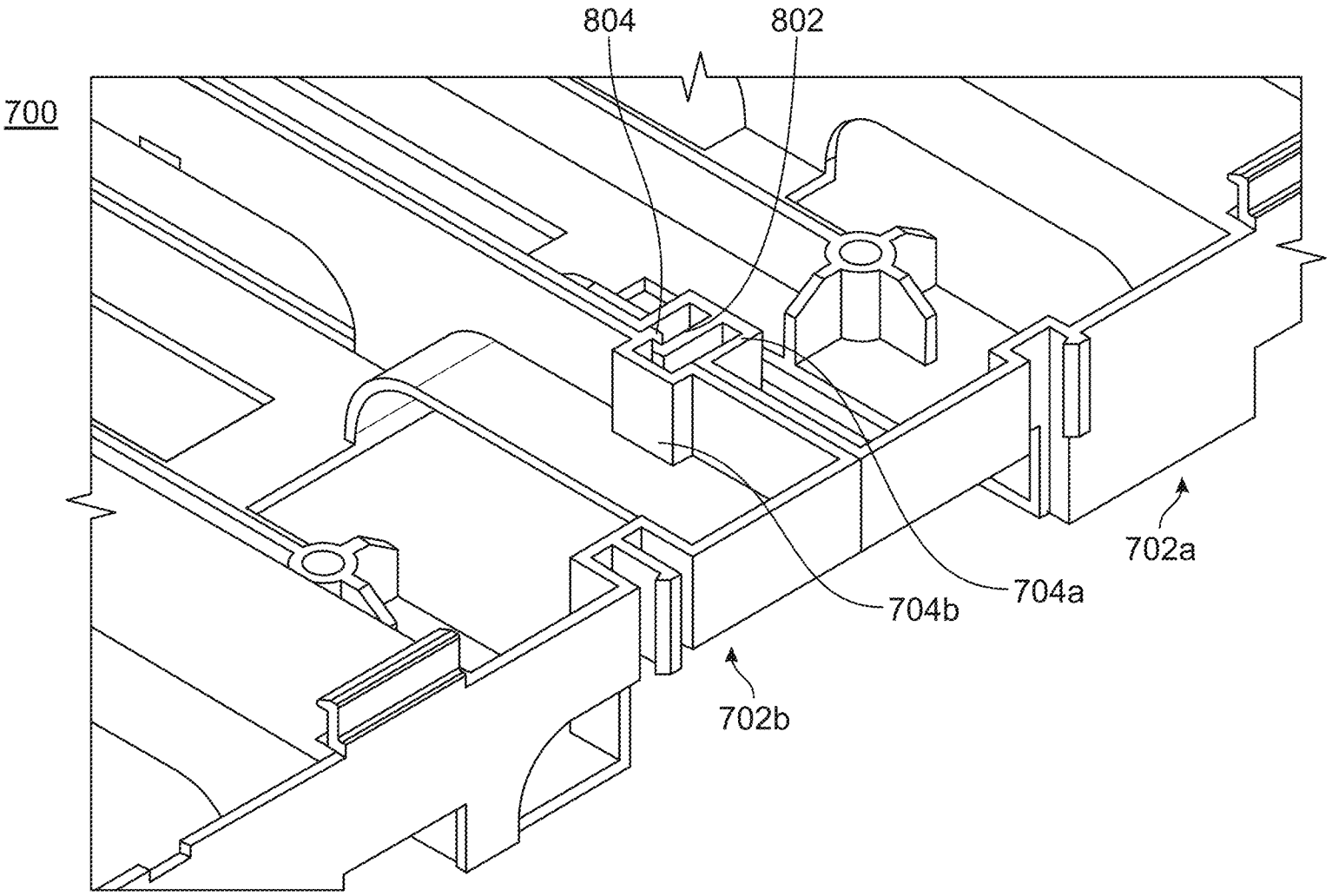
FIG. 8 illustrates an enlarged partial view of the two deck tiles interlocked via the locking mechanism, according to an embodiment of the present invention.

FIG. 7 illustrates a perspective view of two deck tiles attached via a locking mechanism, according to an embodiment of the present invention. As shown in the FIG. 7, a deck tile 702*a* is attached to a deck tile 702*b*. The two deck tiles are attached via the locking mechanisms 116, 104, 105, as discussed above. A locking mechanism 704*a* of the first deck tile 702*a* is fitted inside a locking mechanism 704*b* of the second deck tile 702*b*. Similarly, a locking mechanism 704*c* of the first deck tile 702*a* is fitted inside a locking mechanism 704*d* of the second deck tile 702*b*. An enlarged partial view of the two attached deck tiles is shown in FIG. 8. A lever 802 of the locking mechanism 704*a* is interlocked with a notch 804 of the locking mechanism 704*b* of the second deck tile 702*b*.

Figure 9:
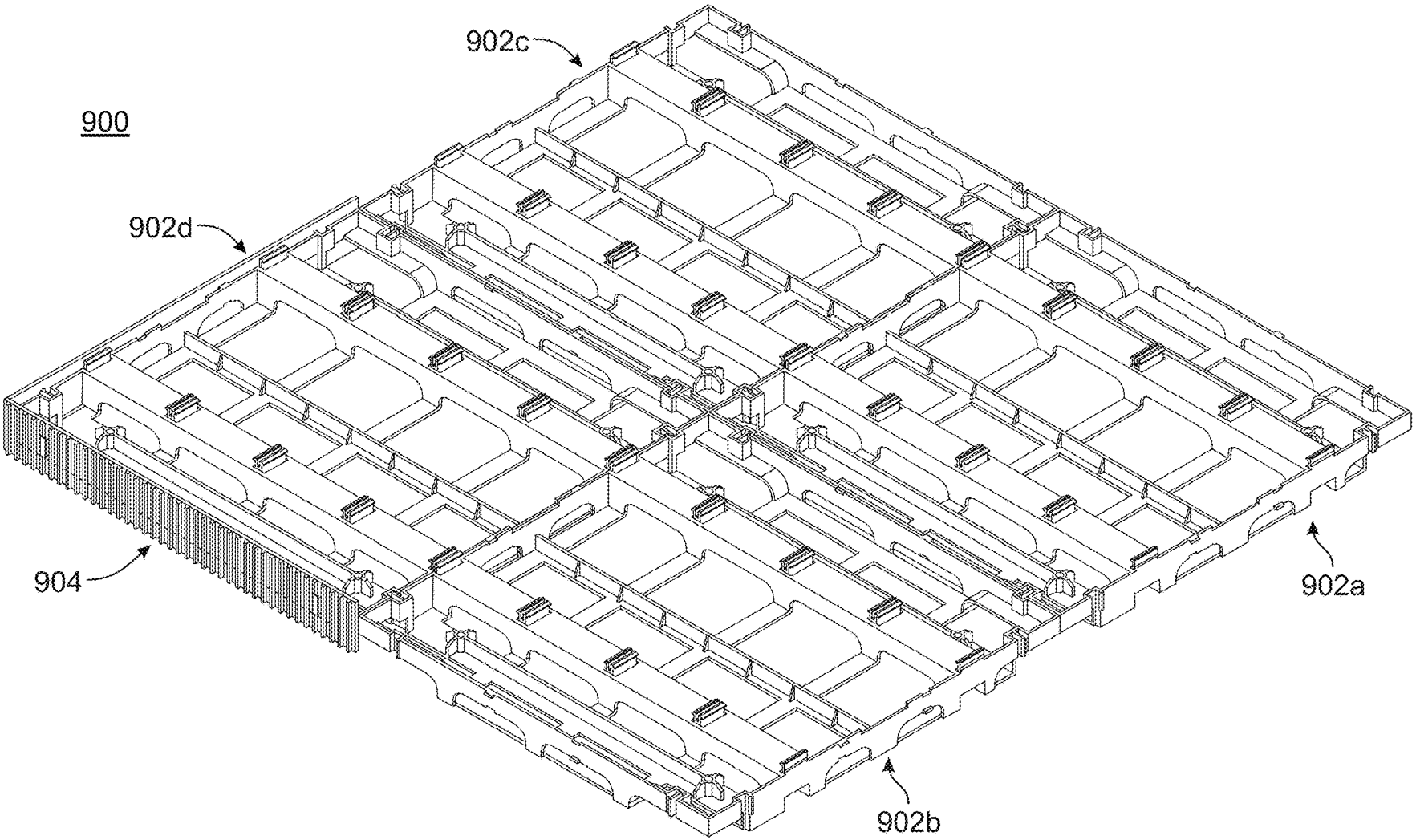
FIG. 9 illustrates a perspective view of the deck tiles having a skirting, according to an embodiment of the present invention.

FIG. 9 illustrates a perspective view 900 of the deck tiles having a skirting 904, according to an embodiment of the present invention. As shown in the FIG. 9, four deck tiles 902*a*, 902*b*, 902*c*, and 902*d* are arranged in a matrix configuration. The deck tiles 902*a*, 902*b*, 902*c*, and 902*d* may have the skirting 904 attached around the matrixed deck tiles 902*a*, 902*b*, 902*c*, and 902*d*. In an embodiment of the present invention, the skirting 904 may be used as a decorative material in order to hide a structure of the frames of the deck tiles 902*a*, 902*b*, 902*c*, and 902*d* after installation. In an embodiment of the present invention, the skirting 904 may be attached around the periphery of the attached four deck tiles 902*a*, 902*b*, 902*c*, and 902*d*.

Figure 10:
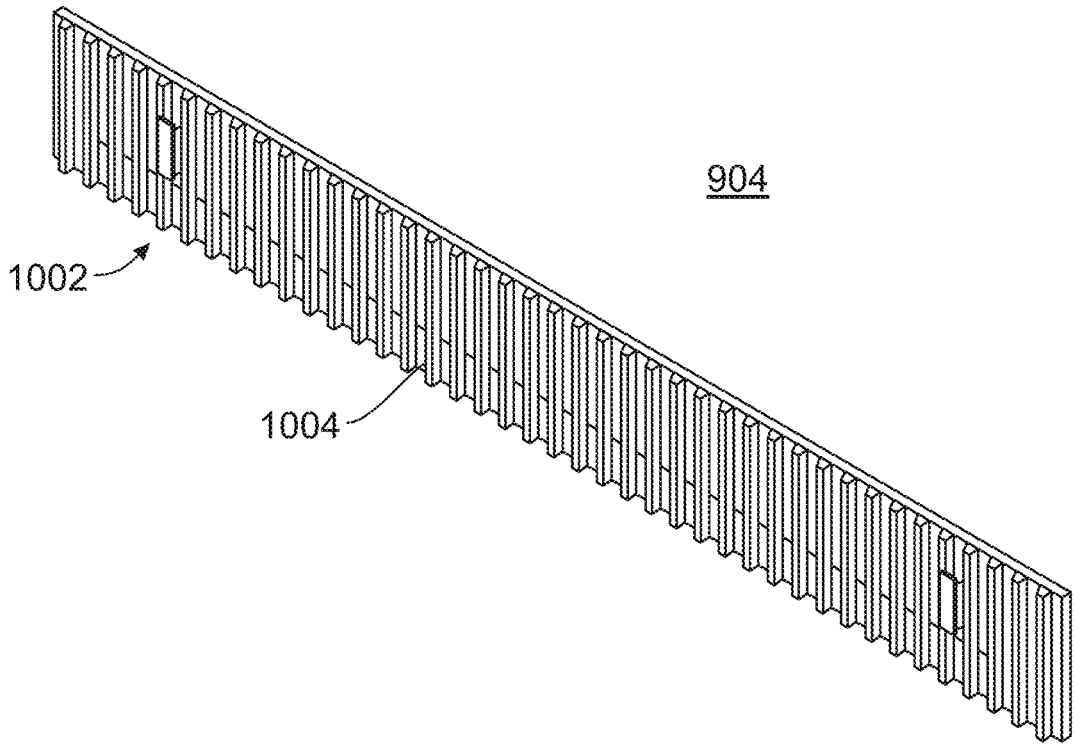
FIG. 10 illustrates a perspective view of the skirting, according to an embodiment of the present invention.

FIG. 10 illustrates a perspective view of the skirting 904, according to an embodiment of the present invention. The skirting 904 may have a frame 1002, in an embodiment of the present invention. The frame 1002 may be rectangle in shape, in an embodiment of the present invention. The frame 1002 may include vertical rods 1004. In an embodiment of the present invention, the vertical rods 1004 may be made up of, but not limited to, a metal, a wood, a rubber, and so forth.

Figure 11:
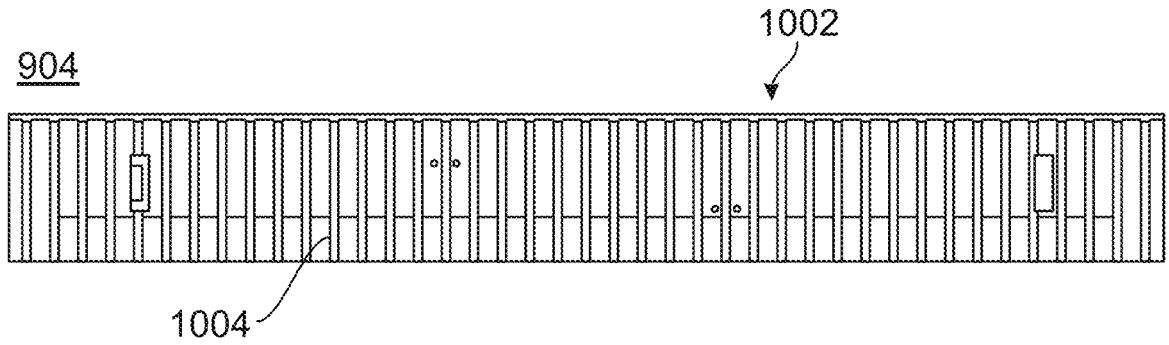
FIG. 11 illustrates a front view of the skirting, according to an embodiment of the present invention.

FIG. 11 illustrates a front view of the skirting 904, according to an embodiment of the present invention. As discussed above, the skirting 904 may comprise the frame 1002 and the vertical rods 1004.

Figure 12:
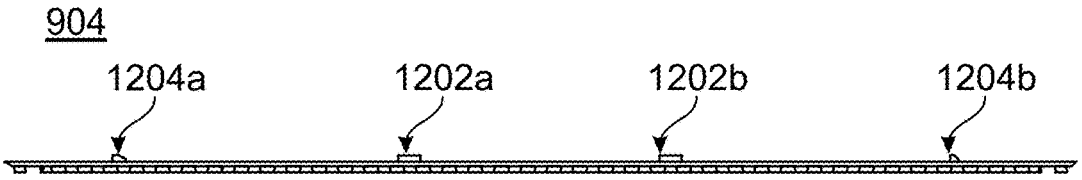
FIG. 12 illustrates a top view of the skirting, according to an embodiment of the present invention.

FIG. 12 illustrates a top view of the skirting 904, according to an embodiment of the present invention. The skirting 904 may include a first protrusion 1202*a* and a second protrusion 1202*b*. The protrusions 1202*a* and 1202*b* may be used to align the skirting 904 with a deck tile 100, in an embodiment of the present invention. Further, the skirting 904 may include two grooves (not shown). One groove may be positioned at a distance downwards from the protrusion 1202*a*, and a second groove may be positioned at a distance upwards from the protrusion 1202*b*. Further, the skirting 904 may include two locking mechanisms 1204*a* and 1204*b*, in an embodiment of the present invention. The two locking mechanisms 1204*a* and 1204*b* may be used to attach the skirting 904 with the locking mechanisms 116 of the deck tile 100. Each of the locking mechanisms 1204*a* and 1204*b* may include a lever (not shown) having a notch at a distal end of the lever from the vertical bars 1004. In an embodiment of the present invention, the two locking mechanisms 1204*a* and 1204*b* may have a snap-in mechanism, which snaps into the locking mechanism 116 of the deck tile 100.

Figure 13:
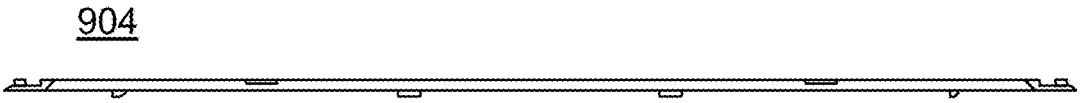
FIG. 13 illustrates a bottom view of the skirting, according to an embodiment of the present invention.
Figure 14:
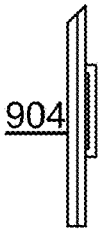
FIG. 14 illustrates a side view of the skirting, according to an embodiment of the present invention.

FIG. 13 illustrates a bottom view of the skirting 904, according to an embodiment of the present invention. FIG. 14 illustrates a side view of the skirting 904, according to an embodiment of the present invention.

Figure 15:
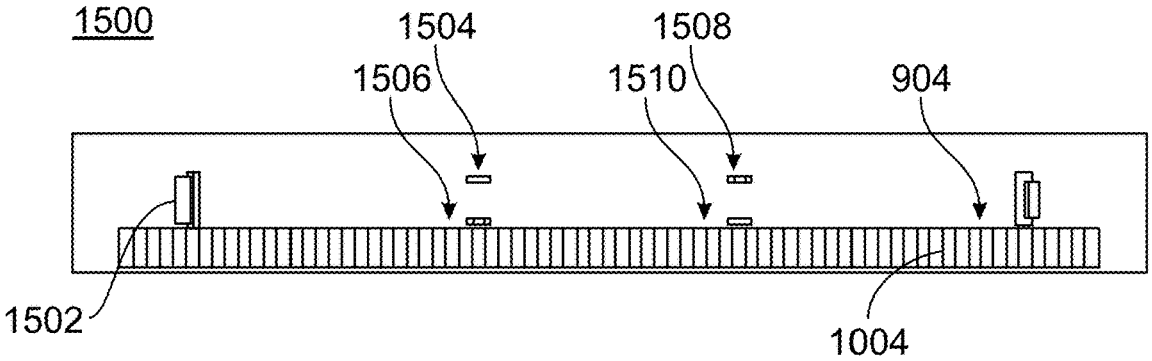
FIG. 15 is an exemplary embodiment of a skirting illustrating a locking mechanism of the skirting and a locking mechanism of a deck tile, according to an embodiment of the present invention.

FIG. 15 is an exemplary view 1500 of the skirting 904 illustrating a locking mechanism 1502 of the skirting 904 and a locking mechanism 116 of a deck tile 100, according to an embodiment of the present invention. The locking mechanism 1502 of the skirting 904 may be a snap in mechanism, in an embodiment of the present invention. The locking mechanism 1502 of the skirting 904 may be snapped-into the locking mechanism (not shown) of the deck tile 100. One protrusion 1506 of the skirting 904 may be inserted into a groove 1504 of the deck tile 100. Similarly, another protrusion (not shown) of the skirting 904 may be inserted into a second groove (not shown) of the deck tile 100. Further, a protrusion 1508 of the deck tile may be inserted into a groove 1510 of the skirting 904. Similarly, another protrusion (not shown) of the deck tile 100 may be inserted into another groove (not shown) of the skirting 904.

Figure 16:
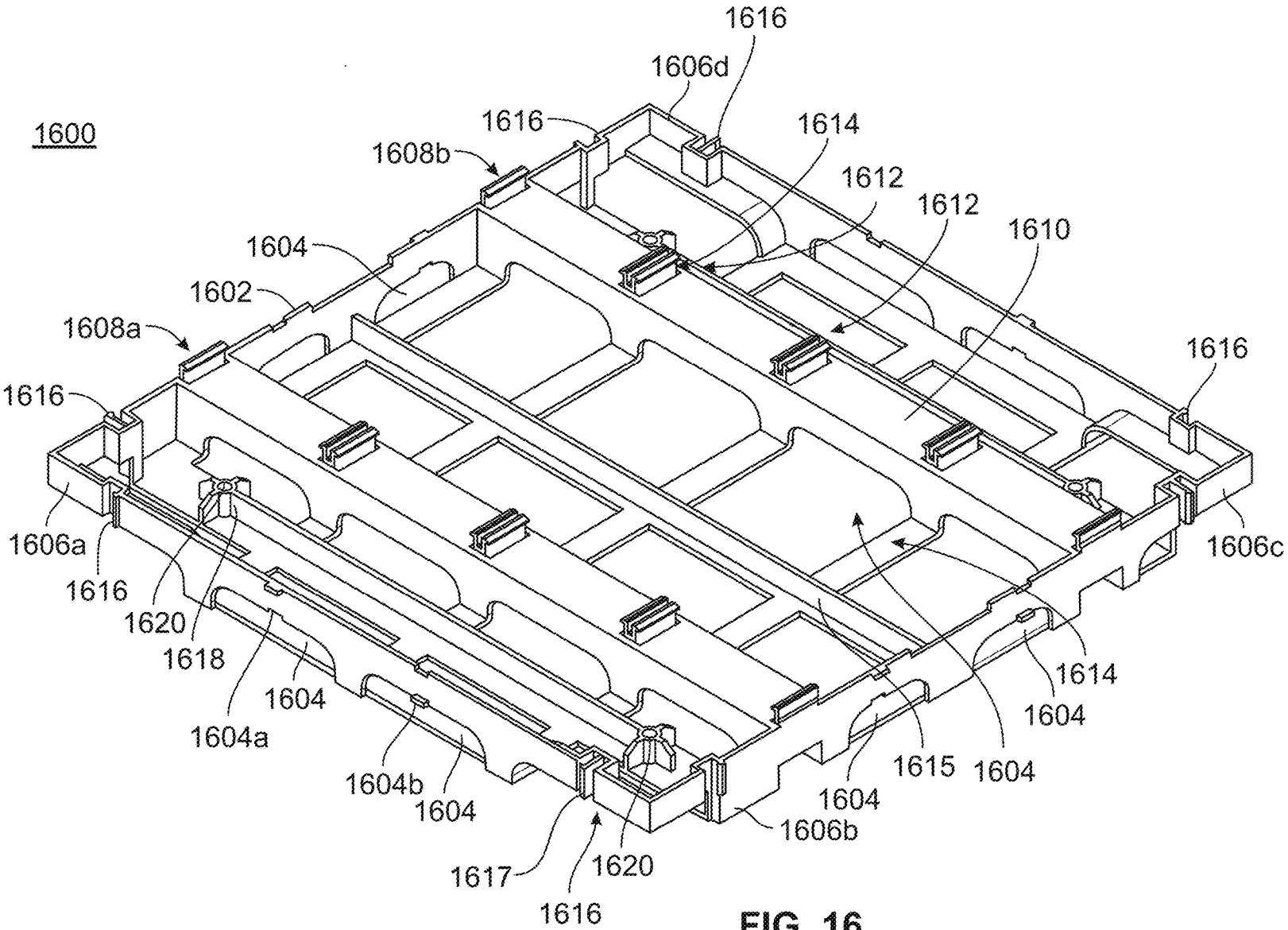
FIG. 16 illustrates a perspective view of a deck tile, according to an alternate embodiment of the present invention.

FIG. 16 illustrates a perspective view of a deck tile 1600, according to an alternate embodiment of the present invention. The deck tile 1600 may be made up of, but not limited to, metal, wood, and so forth. Embodiments of the present invention are intended to include or otherwise cover any material that may be beneficial to provide a durable and robust structure to the deck tile 1600. The deck tile 1600 may comprise a frame 1602. In an embodiment of the present invention, the frame 1602 of the deck tile 1600 may have four sides. Further, each side of the frame 1602 may comprise openings 1604, in an embodiment of the present invention. The opening 1604 may be used for receiving uneven surfaces of a ground and therefore to provide an evenly levelled ground surface for the installation of deck boards. In an embodiment of the present invention, the openings 1604 may be present at a base of each side of the frame 1602. In another embodiment of the present invention, the openings 1604 may be present at the periphery of each side of the frame 1602. In an embodiment of the present invention, each side of the frame 1602 may have two openings 1604. The openings 1604 may be present at an equal distance on the base of each side of the frame 1602, or on the periphery of the frame 1602, in an embodiment of the present invention. In an embodiment of the present invention, the openings 1604 may be in the shape of an arc, a square, a rectangle, and so forth. Embodiments of the present invention are intended to include or otherwise cover any shape and size of the openings 1604 including known, related art, and/or later developed technologies that may be beneficial to receive uneven ground surfaces and to provide a levelled ground surface for installation of a deck on the uneven surfaces. In an embodiment of the present invention, one opening of each side of the frame 1602 may include a groove 1604*a* and a second opening of the each side of the frame 1602 may include a protrusion 1604*b* at the center of each of the openings 1604. In addition, corresponding to the groove 1604*a*, a protrusion 1605*a* may be provided on an edge of a surface of the side, which is located parallel to the groove 1604*a*. Similarly, corresponding to the protrusion 1604*b*, a groove 1605*b* may be provided on an edge of a surface of the side, which is located parallel to the protrusion 1604*b*.

The frame 1602 of the deck tile 1600 may further comprise corners 1606 such as corner 1606*a*, 1606*b*, 1606*c*, and 1606*d* (hereinafter referred to as a corner 1606). Each corner 1606 of the frame 1602 may allow for self-leveling or leveling capabilities with respect to the ground surface such as uneven ground surface. In an embodiment of the present invention, each corner 1606 may be a L-shaped corner attached to two adjacent sides of the frame 1602. In an embodiment of the present invention, the height of each corner 1606 is less than the height of each side of the frame 1602. In an embodiment of the present invention, each corner 1606 may be integrally attached to the two adjacent sides of the frame 1602. In another embodiment of the present invention, each corner 1606 may be removably attached to the two adjacent sides of the frame 1602.

Further, the deck tile 1600 may comprise at least two step clip fastening devices 1608*a* and 1608*b* (hereinafter referred to as step clip fastening device 1608), in an embodiment of the present invention. The step clip fastening device 1608 may comprise a base strip 1610, step clips 1612, and a tab (not shown). The base strip 1610 is preferably made up of glass filled polypropylene, in an embodiment of the present invention. Embodiments of the present invention are intended to include or otherwise cover any material of the base strip 1610 including known, related art, and/or later developed technologies that may be beneficial to provide dimensional stability, rigidity and strength to the base strip 1610.

The step clips 1612 are present along a length of the base strip 1610 as shown in the FIG. 16. The step clip 1612 is designed such that the step clip 1612 may accommodate and hold a deck board (see FIGS. 26A-26B) within its cavity when the deck board is snapped in the step clip 1612. The step clip 1612 may be made up of glass filled polypropylene, in an embodiment of the present invention. Embodiments of the present invention are intended to include or otherwise cover any material of the step clip 1612 including known, related art, and/or later developed technologies that may be beneficial to provide dimensional stability, rigidity and strength to the step clip 1612.

Further, the step clip fastening device 1608 comprises a tab (not shown) that extends vertically downwards from the base of the base strip 1610. The tab may be used to align the step clip fastening device 1608 on the frame 1602 of the deck tile 1600. The tab may be an arc head shaped, which may be used to align the step clip fastening device 1608 on the base of the frame 1602, in an embodiment of the present invention. In another embodiment of the present invention, the tab may be an oval head shaped. In an embodiment of the present invention, the step clip fastening device 1608 including the step clips 1612, tab and base strip 1610, may be a single piece molded over the base of the frame 1602. In another embodiment of the present invention, the step clip fastening device 1608 may be attached as a separate piece to the deck tile 1600. In an embodiment of the present invention, each step clip 1612 may include an anchor (not shown) protruded at its center on an inner cavity of the step clip

1612. The anchor may provide enough friction to deck boards and therefore, restricts movement of deck boards in a horizontal direction. In an embodiment of the present invention, the anchor may be made up of a metal piece such as, but not limited to, stainless steel. In another embodiment of the present invention, the anchor may be made up of rubber, over-molded on the inner cavity of each step clip 1612. Embodiments of the present invention are intended to include or otherwise cover any type of material of the anchor including known, related art, and/or later developed technologies that may be beneficial to provide friction to the deck boards to restrict their movement in the horizontal direction. In an embodiment of the present invention, the anchor may be removably attached to the inner cavity of each step clip 1612. In yet another embodiment of the present invention, the anchor may be permanently attached to the inner cavity of each step clip 1612.

Further, the deck tile 1600 may comprise bars 1614 to provide a support system to the frame 1602, in an embodiment of the present invention. In an embodiment of the present invention, the bars 1614 may be vertical bars, horizontal bars, or a combination thereof. In an embodiment of the present invention, the bars 1614 may be installed in a 3×3 matrix array. Embodiments of the present invention are intended to include or otherwise cover any configuration of a matrix array including known, related art, and/or later developed technologies that may be beneficial to provide a support structure to the frame 1602. A gap between the vertical bars and the horizontal bars are openings, such as the openings 1064, in an embodiment of the present invention.

The frame 1602 of the deck tile 1600 may include a support 1615 between two opposite sides of the frame 1602. The height of the support 1615 may be less than the height of each side of the frame 1602, in an embodiment of the present invention. In an embodiment of the present invention, the support 1615 may be attached on one of the bars 1614 by using a horizontal support structure, as shown in FIG. 17.

The deck tile 1600 may further comprises a plurality of locking mechanisms 1616. The locking mechanism 1616 may be used to attach and/or lock another deck tiles to the deck tile 1600. In an embodiment of the present invention, each side of the frame 1602 may comprise at least two locking mechanisms 1616. Therefore, each deck tile 1600 may comprise at least eight locking mechanisms 1616 at the four sides of the deck tile 1600. In an embodiment of the present invention, the locking mechanism 1616 may be, but not limited to, an interlock mechanism. The locking mechanism 1616 may have a groove that fits in a groove of a locking mechanism of a second deck tile in order to interlock the two deck tiles. In another embodiment of the present invention, the locking mechanism 1616 may be a snap lock mechanism. Embodiments of the present invention are intended to include or otherwise cover any type of locking mechanism including known, related art, and/or later developed technologies that may be beneficial to lock another deck tile or any other attachment. The locking mechanism 1616 may be shaped as a groove having a lever 1617 at a center of the groove, which is protruded outwards from the locking mechanism 1616. In an embodiment of the present invention, the lever 1617 may have a notch at a distal end of the lever 1617. The shape of the notch may be a V-shaped notch, in an embodiment of the present invention. In another embodiment of the present invention, the notch may be round in shape. In an embodiment of the present invention, the lever 1617 and the notch may be made up of a flexible material in order to interlock with a locking mechanism of another deck tile.

Further, the deck tile 1600 may comprise a supporting member 1618 at one side of the frame 1602, which may be used to provide support to deck boards when placed on the deck tile 1600. In an embodiment of the present invention, the supporting member 1618 may comprise a hole 1620 at each end of the supporting member 1618. In an embodiment of the present invention, the hole 1620 may be used to fix the deck tile 1600 on the ground surface by using fastening means. In an embodiment of the present invention, the fastening means may include, but not limited to, fasteners, nails, nuts, screws, pins, and so forth. In an embodiment of the present invention, the holes 1620 passes through the bars 1614 of the deck tile 1600. The frame 1602 may comprise a second supporting member 1618 at the opposite side of the frame 1602, in an embodiment of the present invention.

Figure 17:
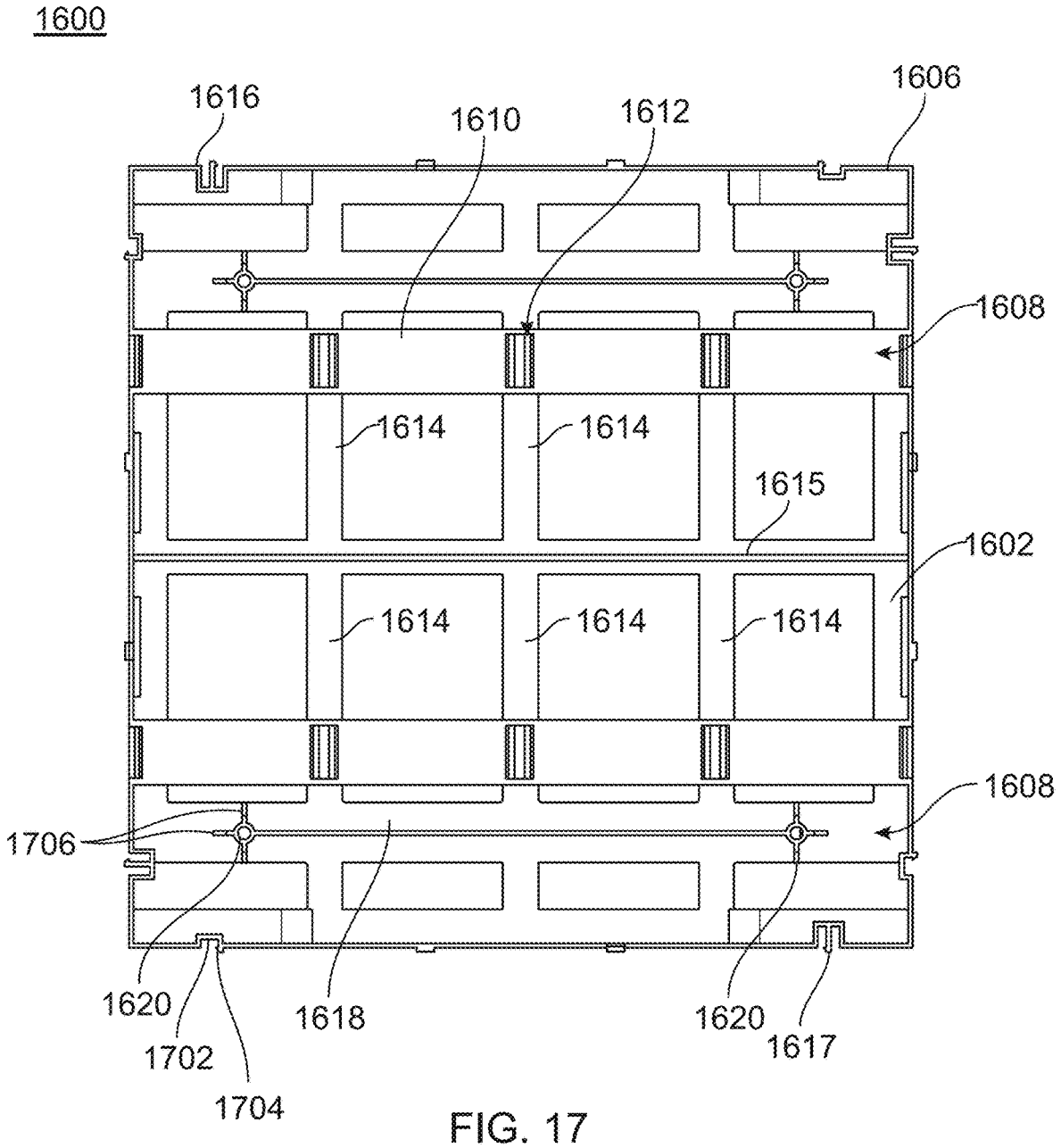
FIG. 17 illustrates a top view of the deck tile as shown in FIG. 16, according to an embodiment of the present invention.

FIG. 17 illustrates a top view of the deck tile 1600, according to an embodiment of the present invention. As discussed above, the deck tile 1600 may include the frame 1602, the corners 1606, and the step clip fastening devices 1608. The step clip fastening devices 1608 comprises the base strip 1610 and the step clips 1612.

Further, the deck tile 1600 comprises bars 1614 for providing a support structure to the frame 1602. The frame 1602 of the deck tile 1600 may include the support 1615 between two opposite sides of the frame 1602. The height of the support 1615 may be less than the height of each side of the frame 1602, in an embodiment of the present invention. In an embodiment of the present invention, the support 1615 may be attached to one of the bars 1614.

The locking mechanism 1616 may be used to attach and/or lock another deck tiles to the deck tile 1600, in an embodiment of the present invention. Each side of the frame 1602 may comprise at least two locking mechanism 1616. One of the locking mechanisms 1616 may have a groove and the lever 1617, as discussed above. The other locking mechanism 1616 may be a hollow groove 1702 without a lever. One side of the groove may have a notch 1704 for interlocking another deck tile. The shape of the notch 1704 may be a V-shaped notch, in an embodiment of the present invention. In another embodiment of the present invention, the notch 1704 may be round in shape. In an embodiment of the present invention, the lever 1617 and the notch 1704 may be made up of a flexible material in order to interlock with a locking mechanism of another deck tile to the deck tile 1600.

Further, the supporting member 1618 that may be used to fix the deck tile 1600 with a ground surface. In an embodiment of the present invention, the supporting member 1618 may comprise the hole 1620 at each end of the supporting member 1618. Each of the hole 1620 may be surrounded by a number of arms 1706.

Figure 18:
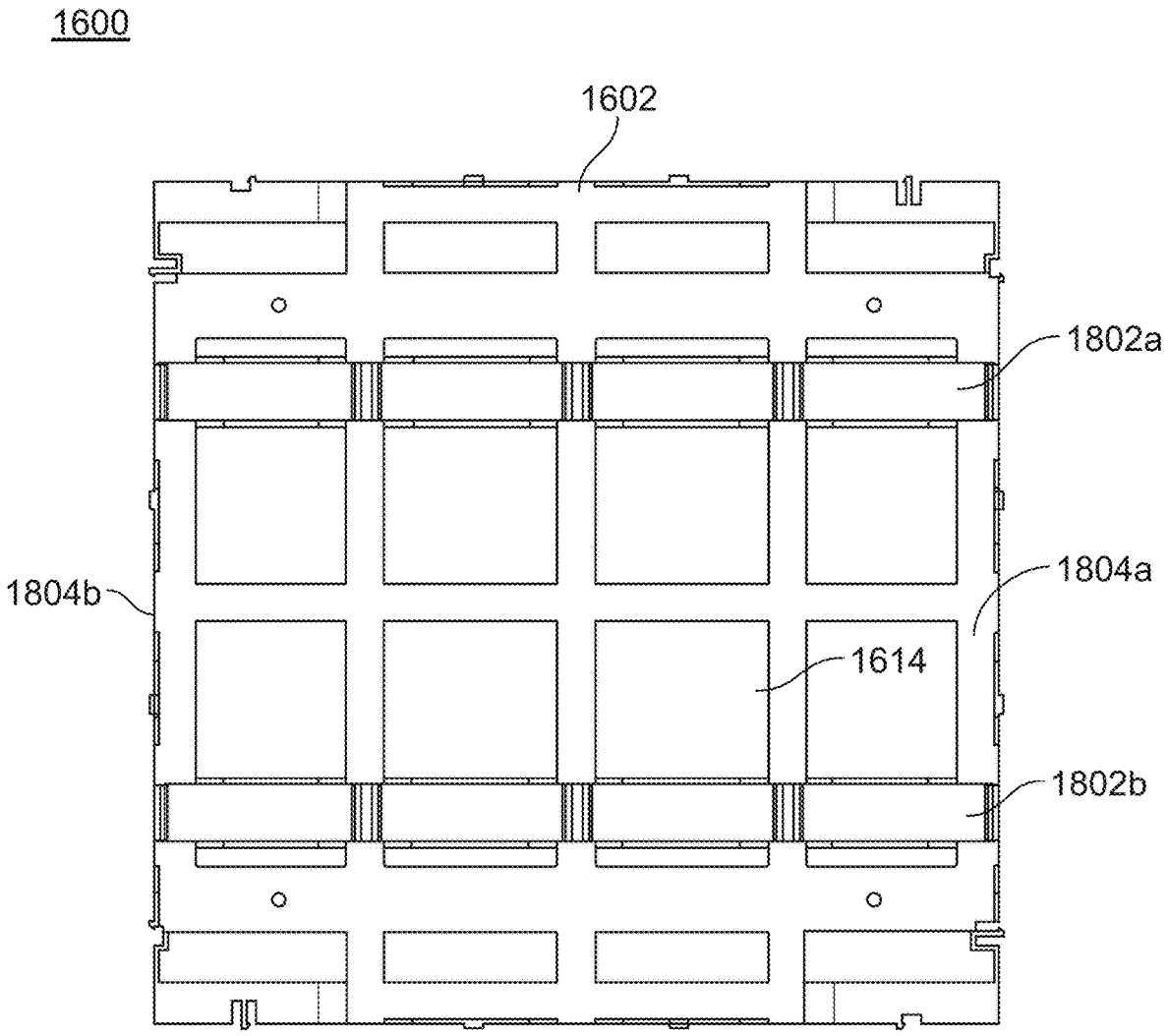
FIG. 18 illustrates a bottom view of the deck tile as shown in FIG. 16, according to an embodiment of the present invention.

FIG. 18 illustrates a bottom view of the deck tile 1600, according to an embodiment of the present invention. The deck tile 1600 comprises two parallel sleepers 1802*a* and 1802*b* (hereinafter referred to as sleeper 1802). The sleeper 1802 may be permanently attached between two opposite sides 1804*a* and 1804*b* of the frame 1602. In an embodiment of the present invention, the sleeper 1802 may be mounted on the bars 1614. In an embodiment of the present invention, the sleeper 1802 may be made up of, but not restricted to, metal, wood, plastic, and so forth. On the sleeper 1602, the step clip fastening devices 1608 are mounted by using the tabs of the step clip fastening device 1608, in an embodiment of the present invention.

Figure 19:
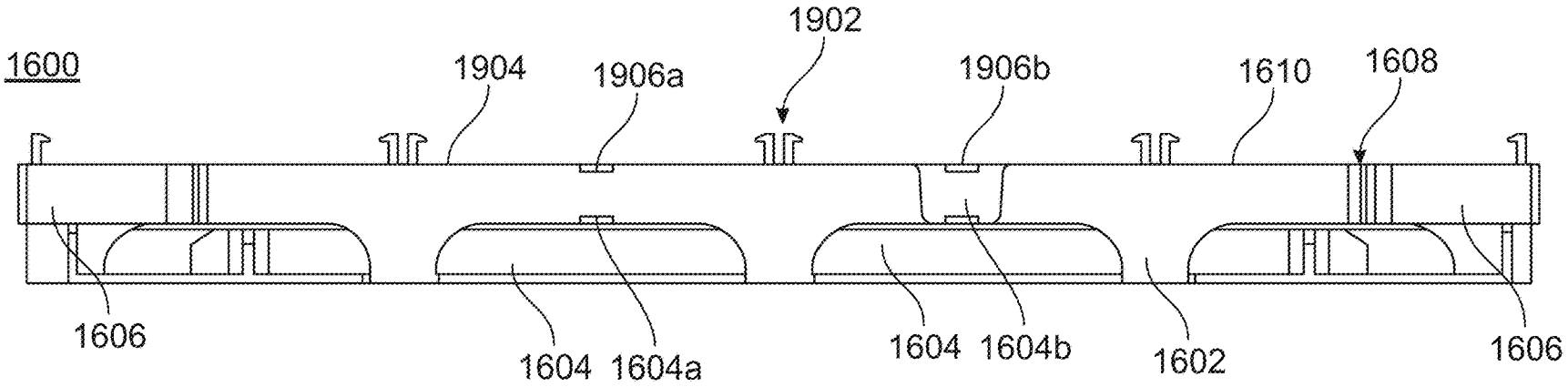
FIG. 19 illustrates a front view of the deck tile as shown in FIG. 16, according to an embodiment of the present invention.

FIG. 19 illustrates a front view of the deck tile 1600, according to an embodiment of the present invention. The deck tile 1600 comprises the step clip fastening device 1608. The step clip fastening device 1608 comprises the base strip 1610, and the step clips 1612. When two step clips 1612 are attached together facing opposite to each other, a step clip set 1902 is formed. In an embodiment of the present invention, each step clip fastening device 1608 may comprise three step clip sets and two step clips 1612 facing each other at the ends of the base strip 1610. In an embodiment of the present invention, the length of the base strip 1610 may be equal to the length of a side of the frame 1602.

The deck tile 1600 further comprises two openings 1604 and 1604 at each side of the frame 1602. In an embodiment of the present invention, the openings 1604 may be rectangular in shape having rounded corners. The openings 1604 may be used to level the frame 1602 with the ground surface. One of the opening 1604 may include a groove 1604*a* and a second opening 1604 may include a protrusion 1604*b* at the center of each of the openings 1604. Further, an upper edge 1904 of the frame 1602 may include a protrusion 1906*a* corresponding to the groove 1604*a*, and a groove 1906*b* corresponding to the protrusion 1604*b*. The protrusion 1906*a* and the groove 1604*a* may provide a locking mechanism to interlock and/or attach a second deck tile with.

Figure 20:
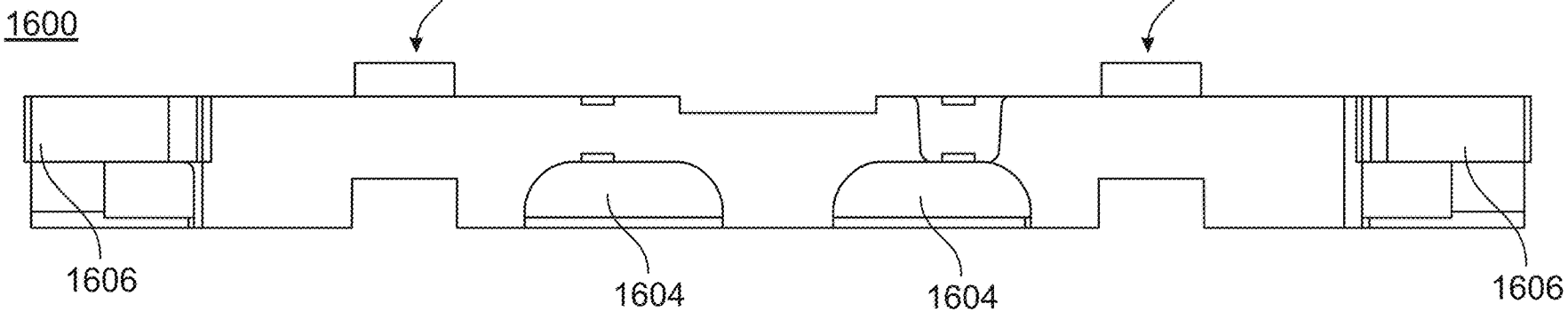
FIG. 20 illustrates a side view of the deck tile as shown in FIG. 16, according to an embodiment of the present invention.

FIG. 20 illustrates a side view of the deck tile 1600, according to an embodiment of the present invention. Each side of the frame 1602 comprises the openings 1604. Further, the deck tile 1600 comprises the corners 1606. Further, the deck tile 1600 comprises the step clip fastening devices 1608, as discussed in the FIG. 16.

Figure 21:
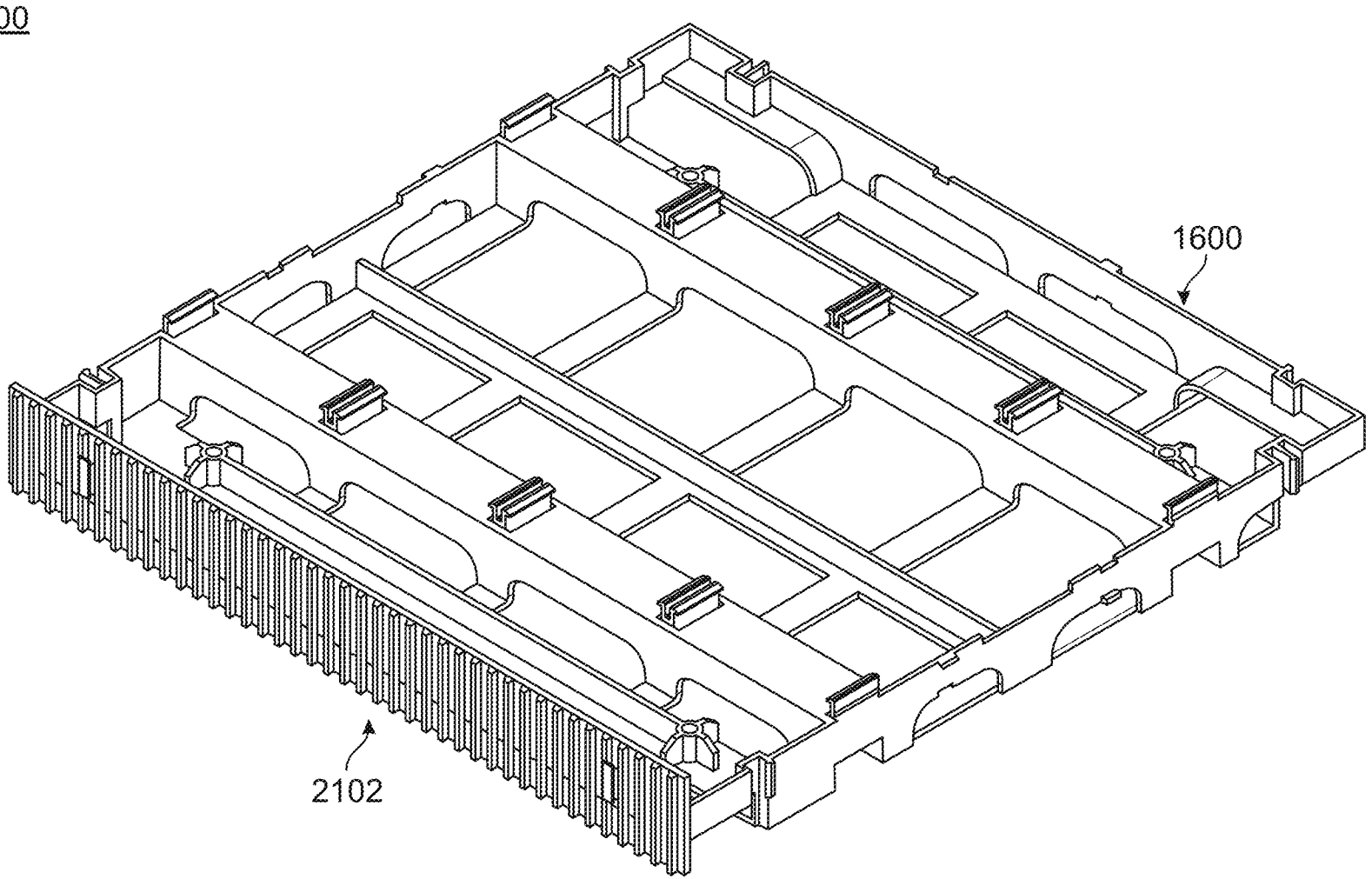
FIG. 21 illustrates a perspective view of the deck tile as shown in FIG. 16, such that a skirting is attached with the deck tile, according to an exemplary scenario of the present invention.

FIG. 21 illustrates a perspective view 2100 of the deck tile 1600, according to an exemplary scenario of the present invention. A skirting 2102 may be attached to the deck tile 1600 in an embodiment of the present invention. A protrusion of the skirting 2102 may be inserted into a groove of the deck tile 1600. Similarly, a protrusion of the deck tile 1600 may be inserted in a groove of the skirting 2102. In addition, locking mechanisms of the deck tile are inserted into the locking mechanisms of the skirting 2102, as explained above.

Figure 22:
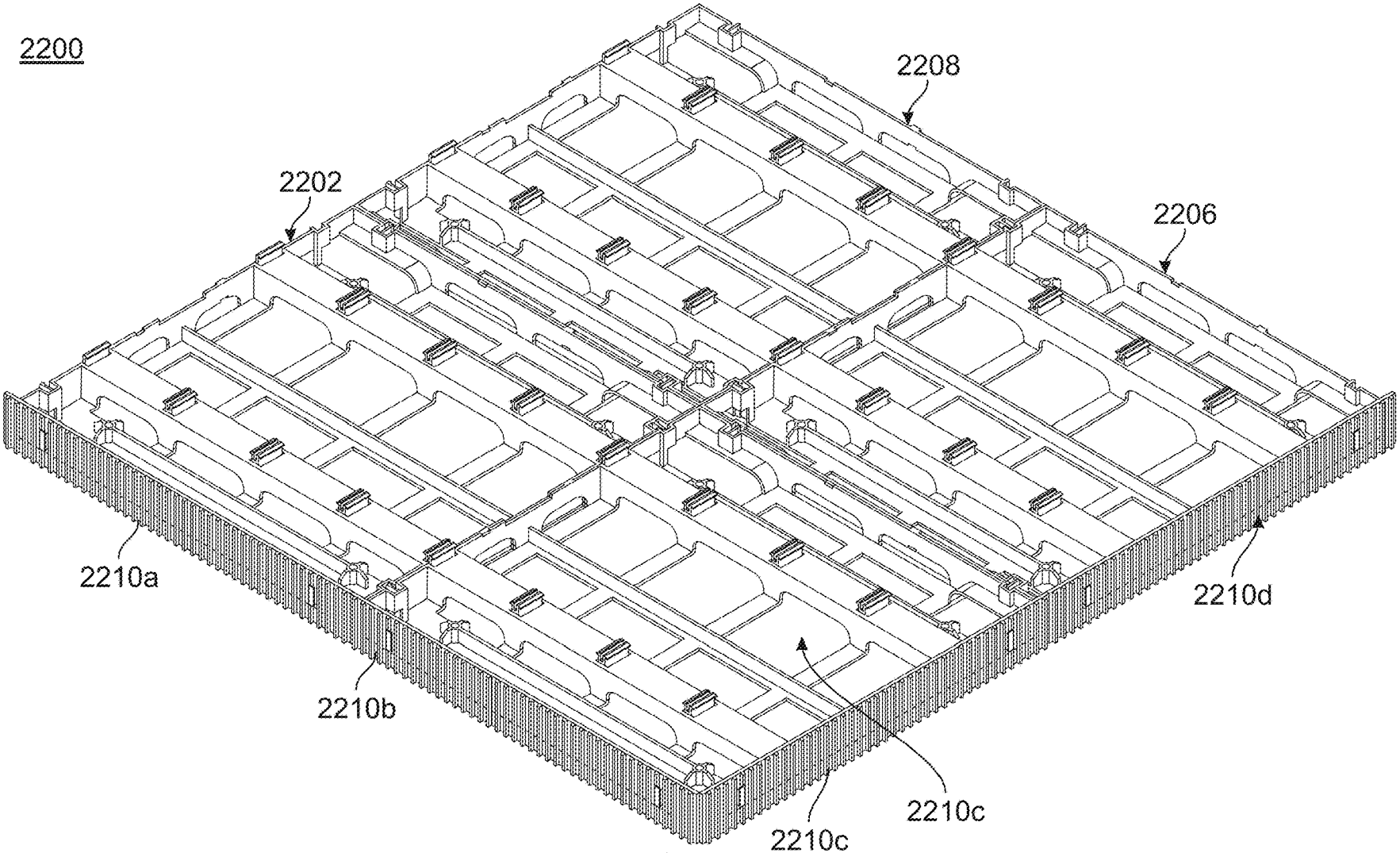
FIG. 22 illustrates a perspective view of deck tiles arranged on a ground surface, according to an exemplary scenario of the present invention.
Figure 23:
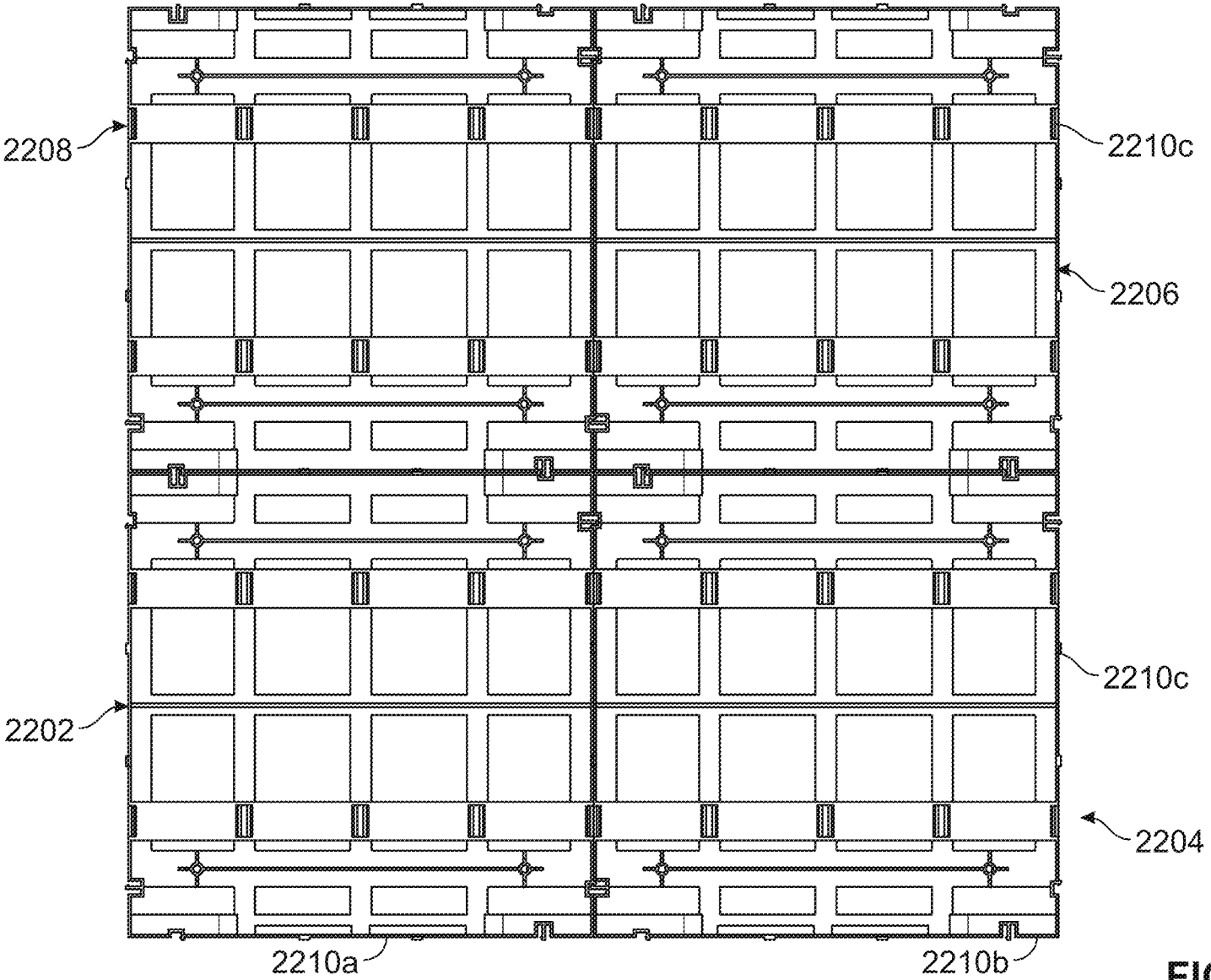
FIG. 23 illustrates a top view of deck tiles arranged in a 2×2 matrix configuration, according to an exemplary scenario of the present invention.

FIG. 22 illustrates a perspective view 2200 of deck tiles arranged on a ground surface, according to an exemplary scenario of the present invention. Deck tiles 2202, 2204, 2206, and 2208 are attached to each other, as discussed above, by using the locking mechanisms. The deck tiles 2202, 2204, 2206, and 2208 are arranged in a 2×2 matrix, in the exemplary scenario. Embodiments of the present invention may include any arrangement of deck tiles in a N×M matrix configuration, wherein N and M are positive integers. In an embodiment of the present invention, a value of N may be same as a value of M. In another embodiment of the present invention, a value of N may be different from a value of M. Further, skirtings 2210*a*-2210*d* may be attached along a perimeter of the matrix of the deck tiles 2202, 2204, 2206, and 2208, in an embodiment of the present invention. FIG. 23 illustrates a top view of the deck tiles 2202, 2204, 2206, and 2208 arranged in the 2×2 matrix configuration. The skirtings 2210*a*-2210*d* may be attached along the perimeter of the matrix of the deck tiles 2202, 2204, 2206, and 2208.

Figure 24:
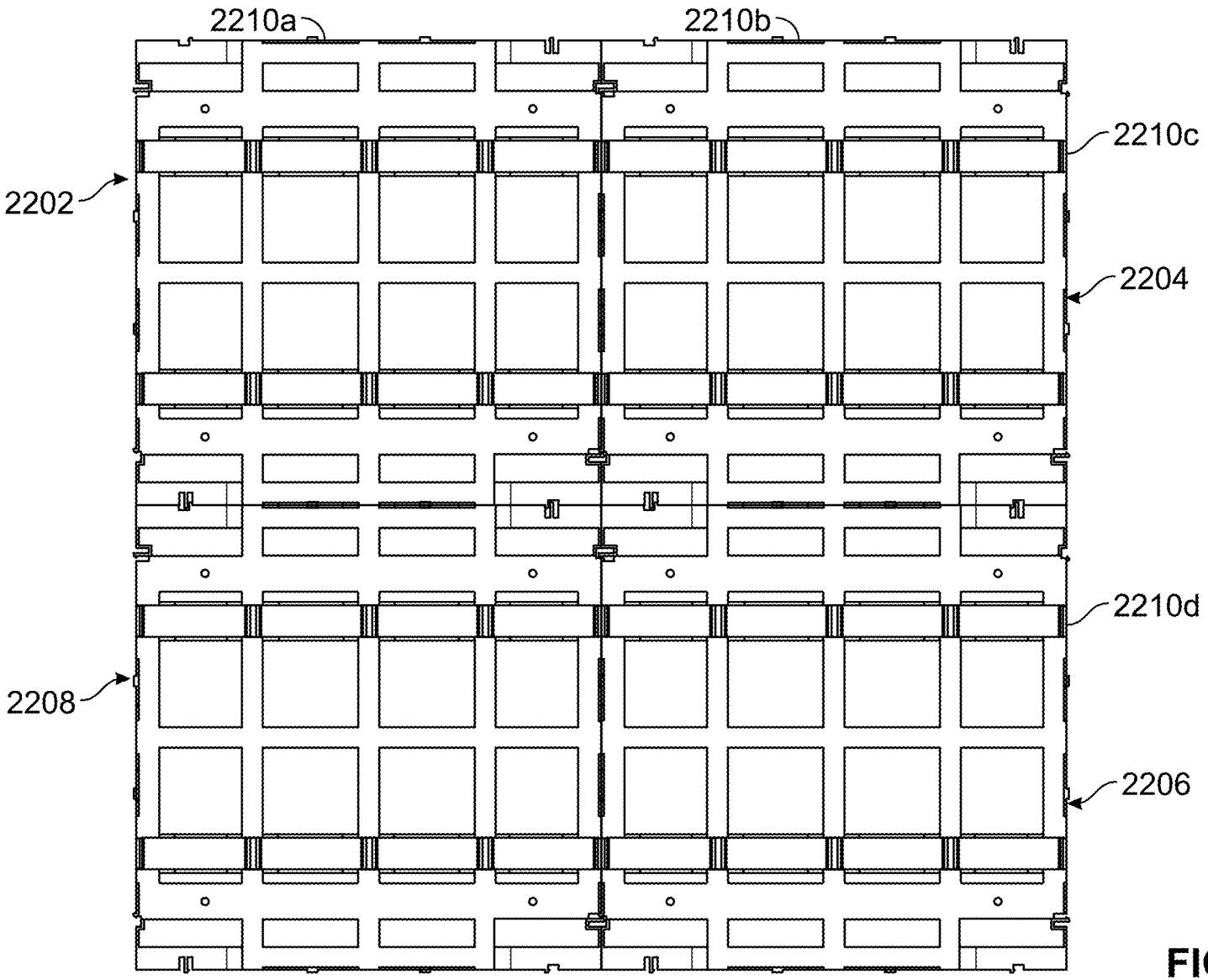
FIG. 24 illustrates a bottom view of deck tiles arranged in a 2×2 matrix configuration, according to an exemplary scenario of the present invention.

FIG. 24 illustrates a bottom view of the deck tiles 2202, 2204, 2206, and 2208 arranged in a 2×2 matrix configuration. The skirtings 2210*a*-2210*d* may be attached along the perimeter of the matrix of the deck tiles 2202, 2204, 2206, and 2208.

Figure 25:
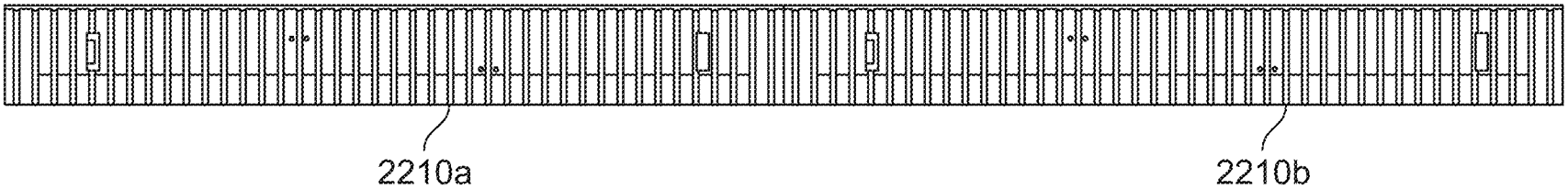
FIG. 25 illustrates a front view of deck tiles arranged in a 2×2 matrix configuration, according to an exemplary scenario of the present invention.

FIG. 25 illustrates a front view of the deck tiles 2202, 2204, 2206, and 2208 arranged in a 2×2 matrix configuration. The skirtings 2210*a* and 2210*b* may be attached along the perimeter of the matrix of the deck tiles 2202, and 2204.

Figure 26A:
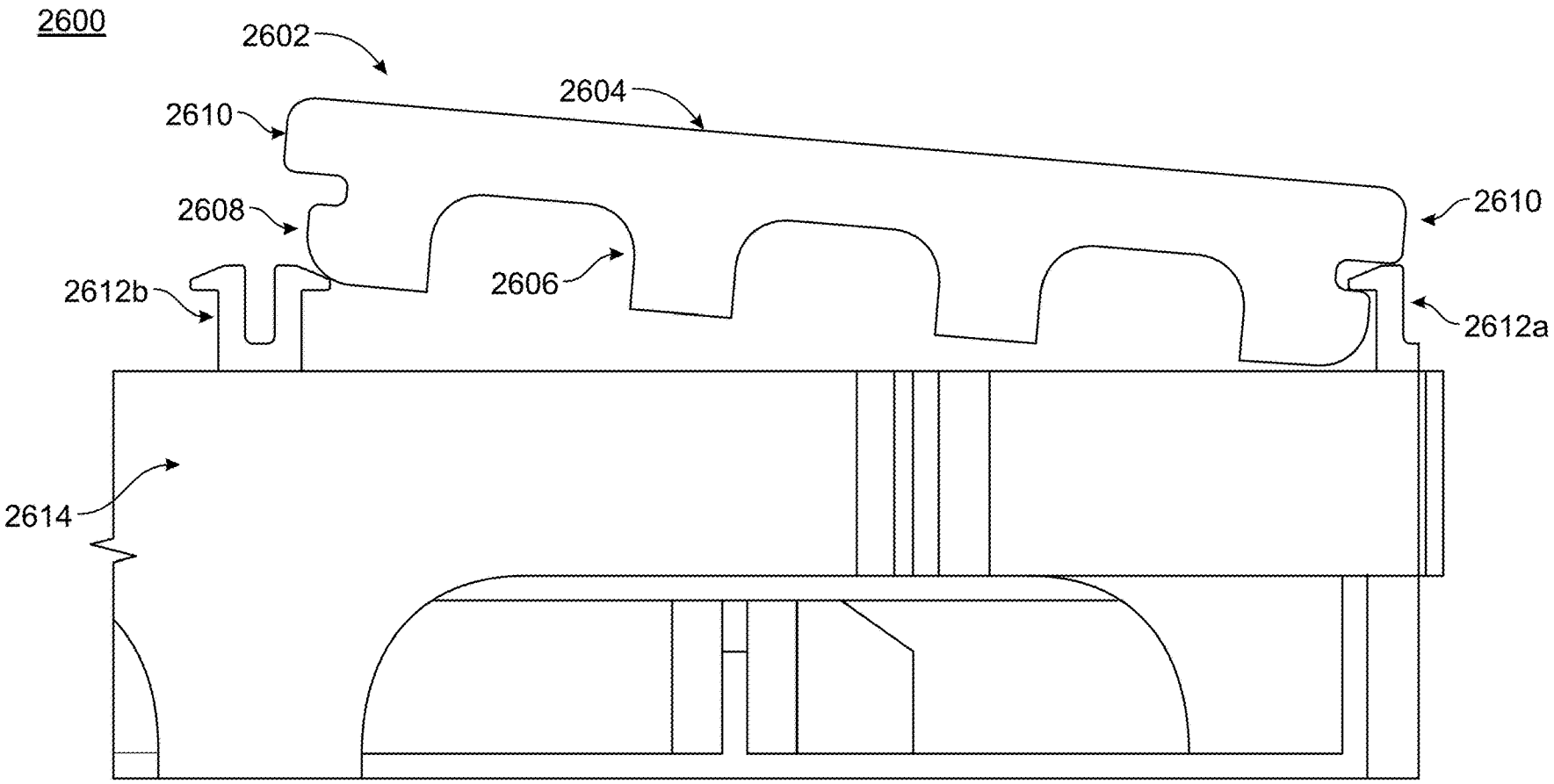
FIGS. 26A and 26B illustrate an exemplary scenario and a method in which a deck board is snapped into a step clip on the deck tile, according to an embodiment of the present invention.
Figure 26B:
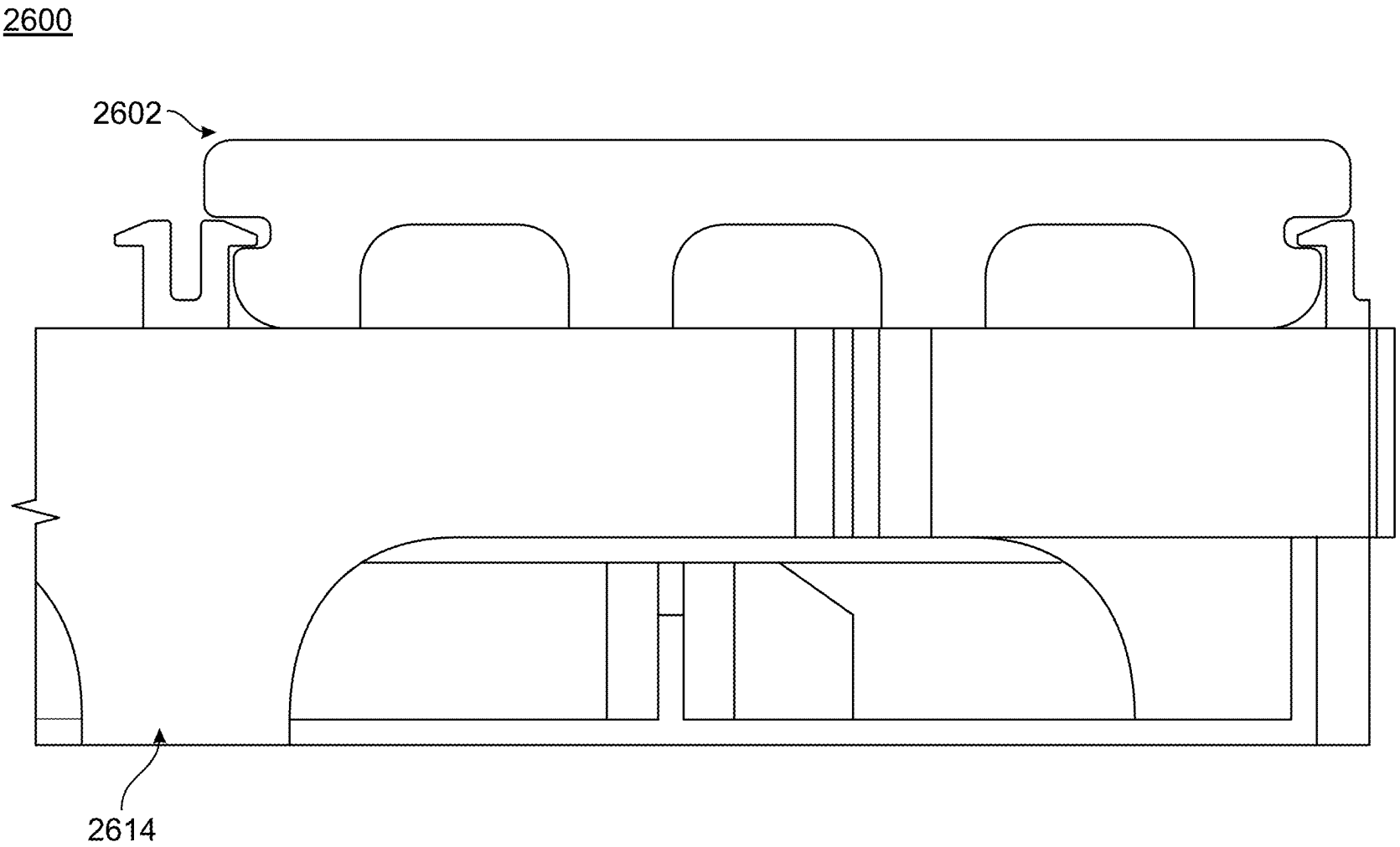

FIGS. 26A and 26B illustrates an exemplary scenario and a method in which a deck board is snapped into a step clip 2612 on the deck tile 2614, according to another embodiment of the present invention. The deck board 2602 may comprise a flat upper surface 2604 and a protruded bottom surface 2406 with a plurality of cavities. The deck board 2602 further comprises at each end, a lower lip 2608 and an upper lip 2610, which defines a portion of a groove in between. As shown in the FIG. 26A, one end of the deck board 2602 is inserted into the step clip 2612*a* and the other end of the deck board 2602 is pressed against the top surface of a corresponding step clip 2612*b* of a deck tile 2614. The step clips 2612*a* and 2612*b* fit into the grooves of the deck board 2602 on both ends. Once the deck board 2602 is pressed, then the deck board 2602 is completely snapped and locked within the deck tile 2614, as shown in FIG. 26B.

Figure 26C:
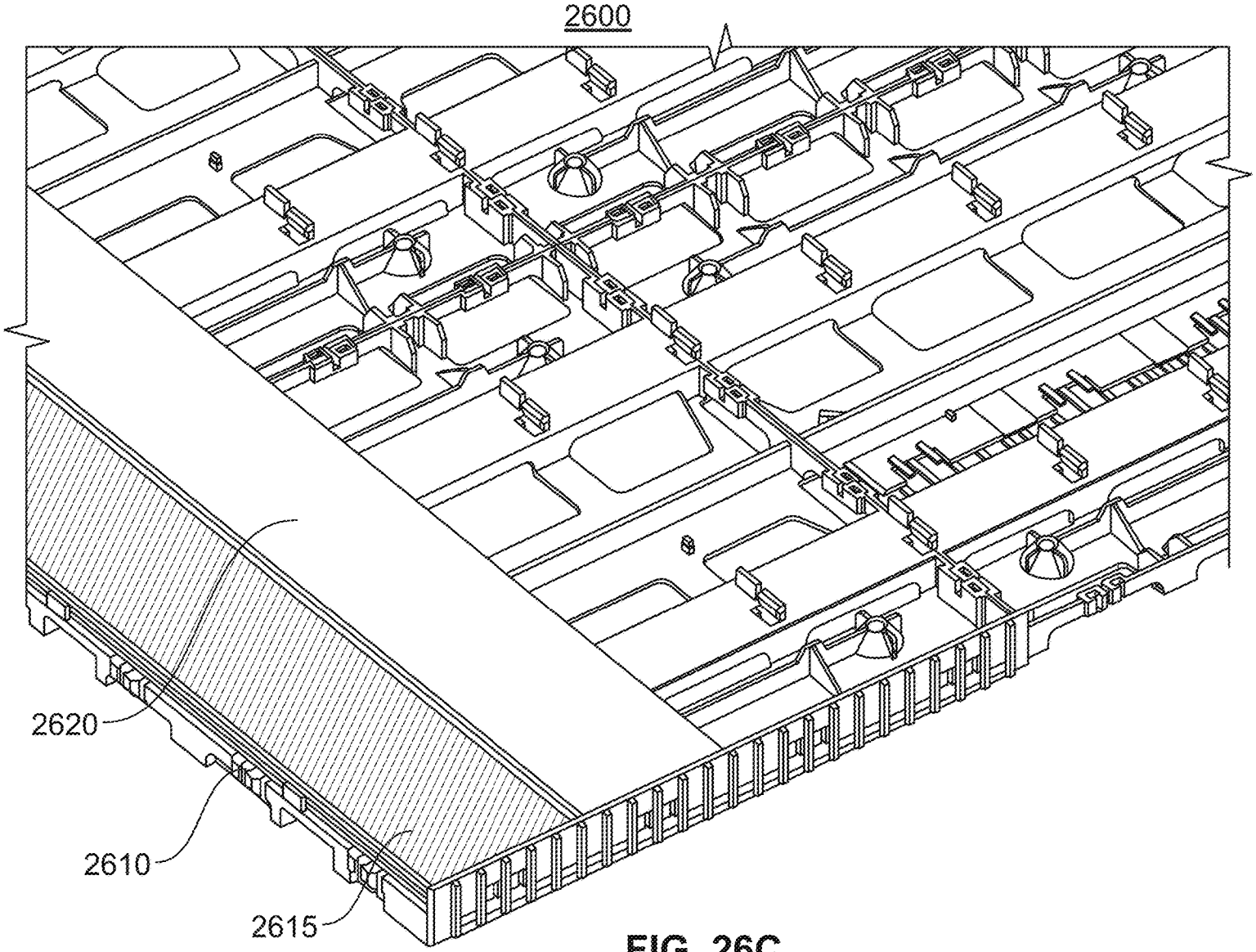
FIGS. 26C and 26D illustrate another exemplary scenario in which deck boards and trim is added to the deck tile assembly.

In another illustrative embodiment as shown in FIG. 26C, the deck boards 2610, 2615 can be utilized. The deck boards 2615, 2620 will enhance the aesthetic appeal of the entire assembly. In addition, the deck boards 2615, 2620 will also protect various portions of the assembly. Trim 2610 will also be added to enhance the aesthetic appeal of the deck board assembly. The trim 2610, like the deck boards 2615, 2620, will also provide greater protection to various portions of the deck board assembly.

Figure 26D:
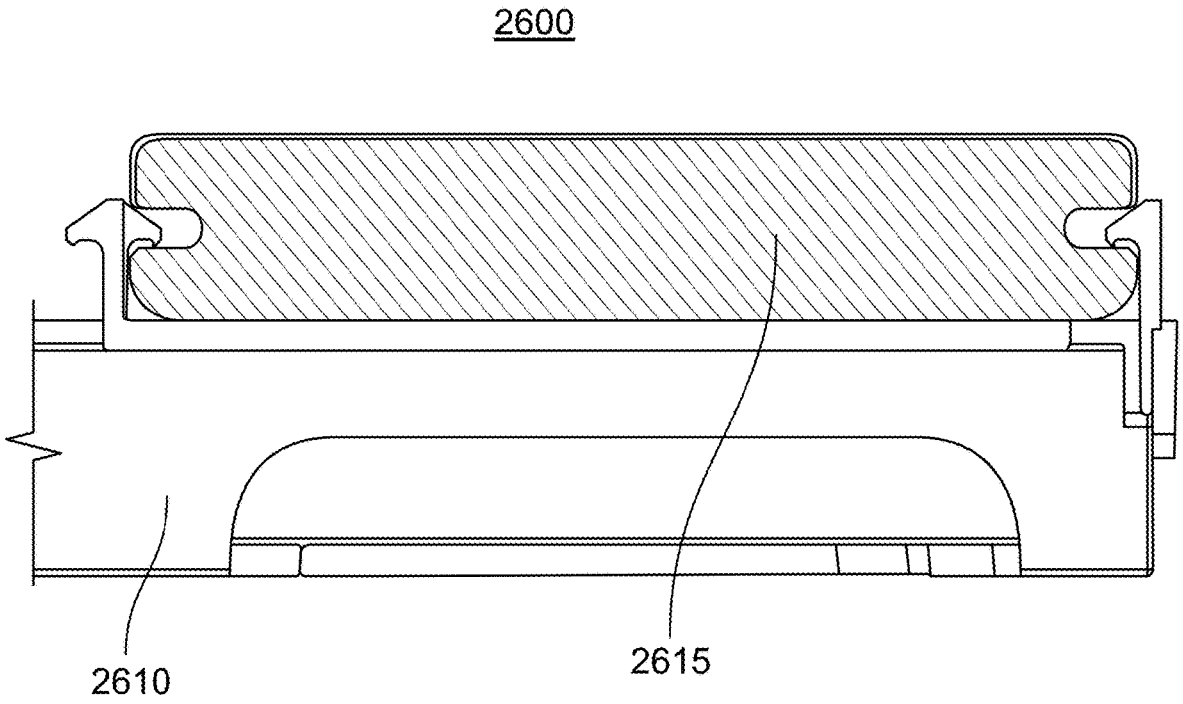

Referring to FIG. 26D, another exemplary illustration is shown. Moreover, a side view of the deck board assembly 2600 is shown. A new size of the deck board 2615 is shown for enhanced aesthetic appeal and protection. The trim 2610 is also illustrated. Moreover, the user, in other various embodiments, can use an different size of the deck board 2615 to provide enhanced aesthetic appeal of the deck board assembly 2600 as well as provide greater protection to other portions of the deck board assembly 2600.

Figure 26E:
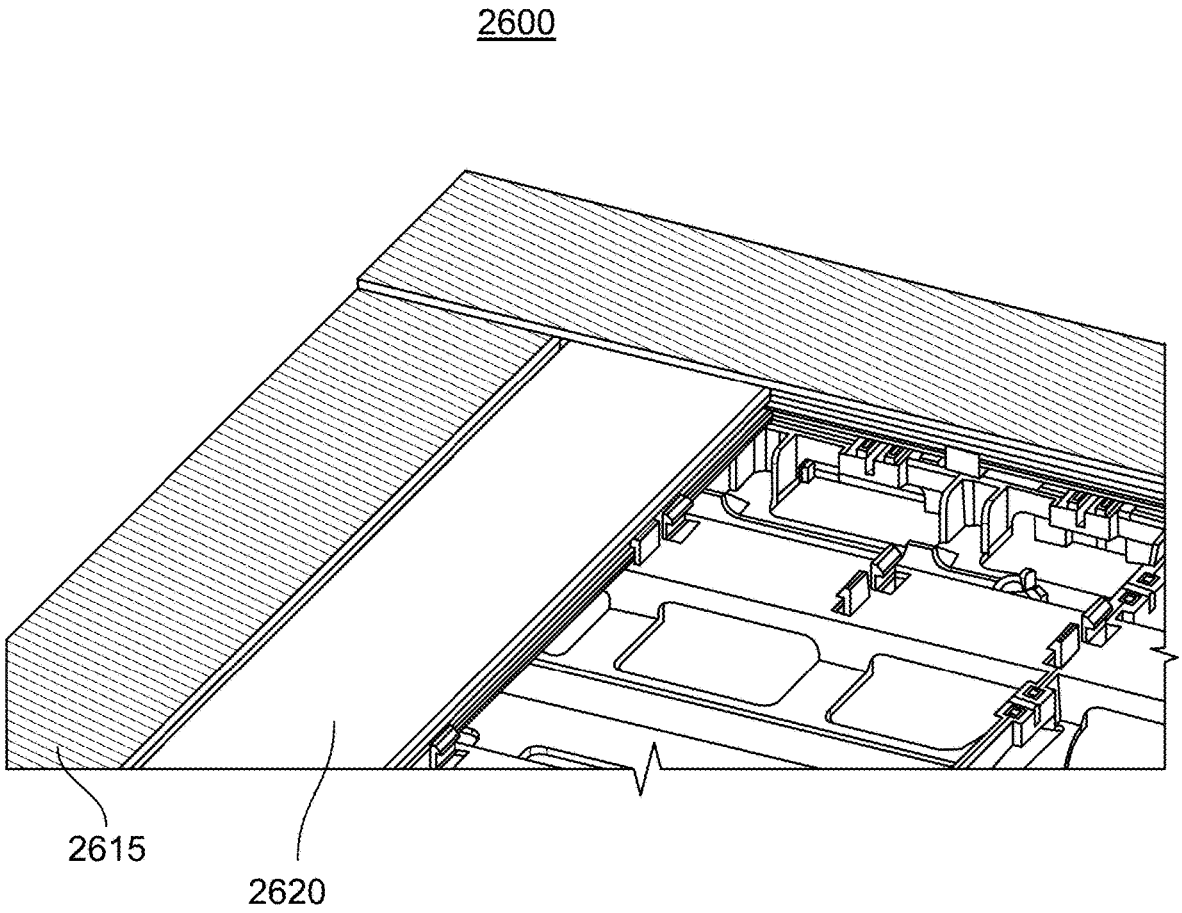
FIG. 26E illustrates how tiles can be turned ninety degrees and locked for a picture frame appearance.

In reference to FIG. 26E, the deck board assembly 2600 can be rotated ninety degrees to and locked in position in other illustrative embodiments. The deck boards 2615, 2620 are also shown. When the deck board assembly 2600 is rotated ninety degrees and locked in position, the deck board assembly will have a greater aesthetic appeal due to the deck board assembly being configured as a picture frame.

Figure 27:
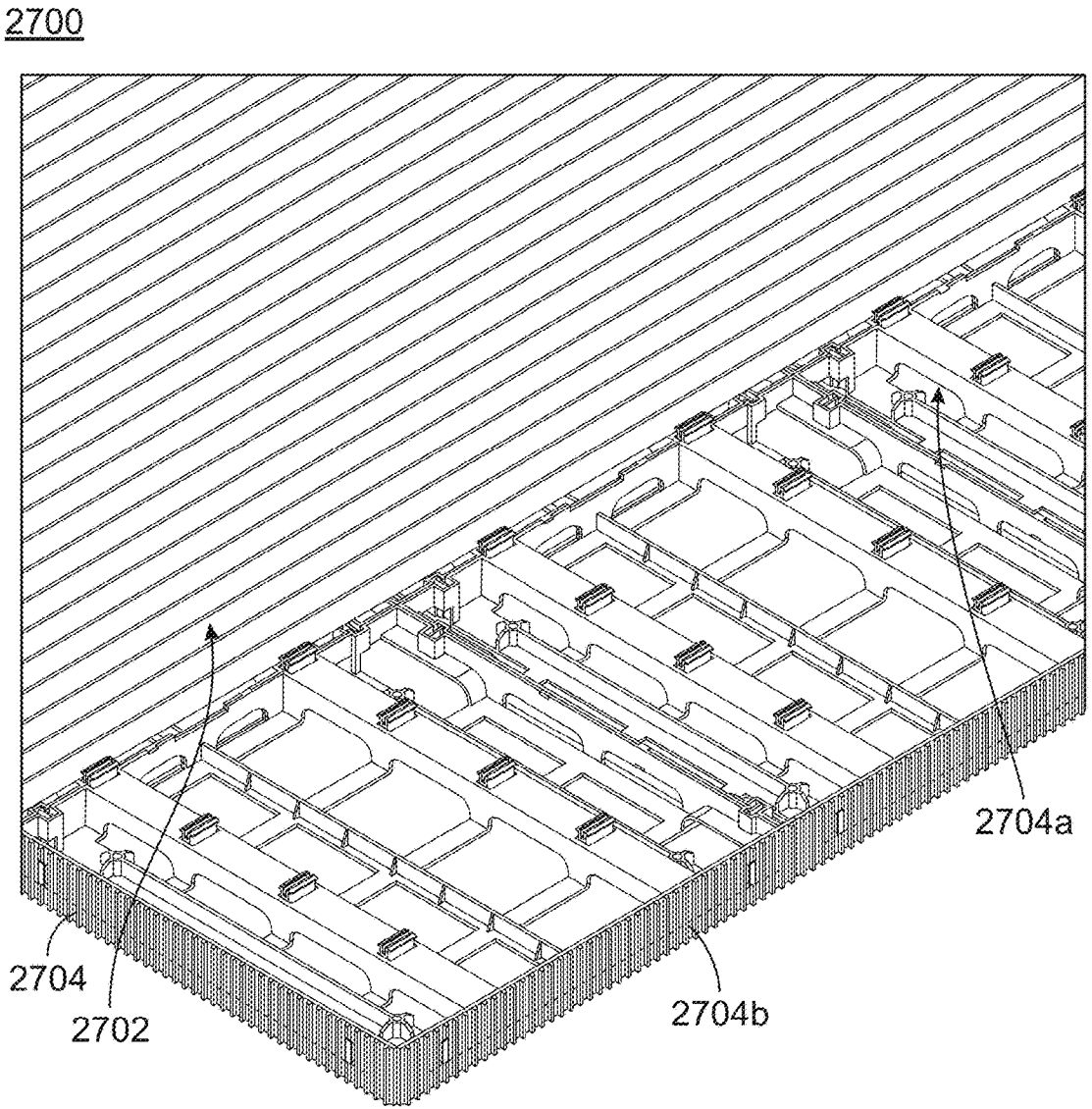
FIG. 27 illustrates an exemplary scenario in which deck boards are snapped on a matrixed deck tiles and a skirting is included around the matrixed deck tiles, according to an embodiment of the present invention.

FIG. 27 illustrates an exemplary scenario 2700 post installation of the deck tiles. As shown in the FIG. 27, deck boards 2702 are snapped on a matrixed deck tiles 2704*a* and 2704*b* and a skirting 2706 is attached around the matrixed deck tiles, according to an embodiment of the present invention.

Figure 28A:
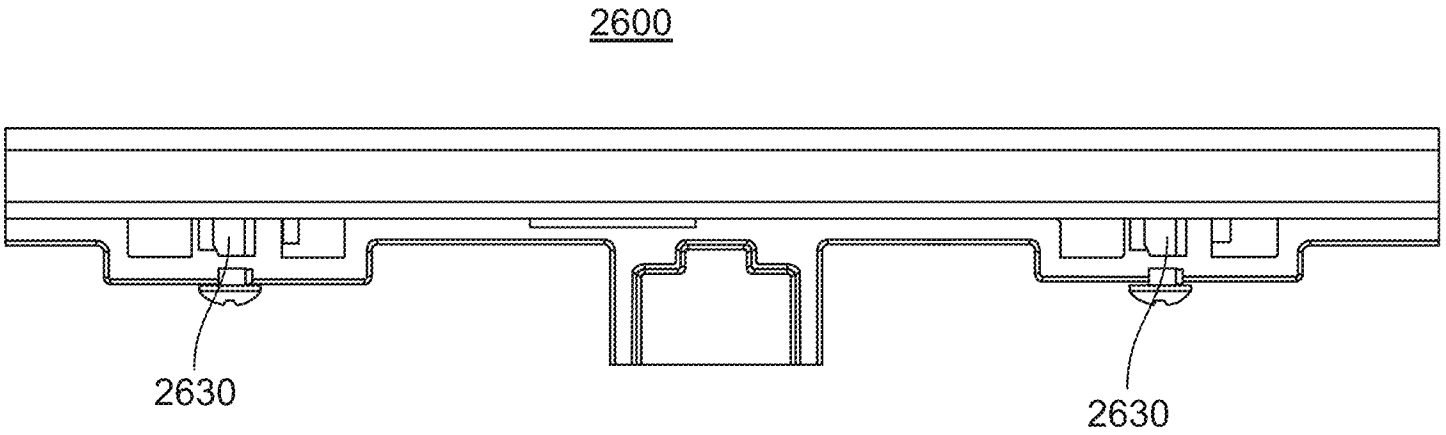
FIGS. 28A and 28B illustrate exemplary embodiments where solid wood boards are attached according to an embodiment of the invention.

In FIG. 28A, in various illustrative embodiments, solid components 2630 will be installed within the deck board assembly 2600. The solid components 2630 will provide greater structural enhancement to the deck board assembly 2600. The deck board assembly 2600 will remain sturdy for greater intervals of time.

Figure 28B:
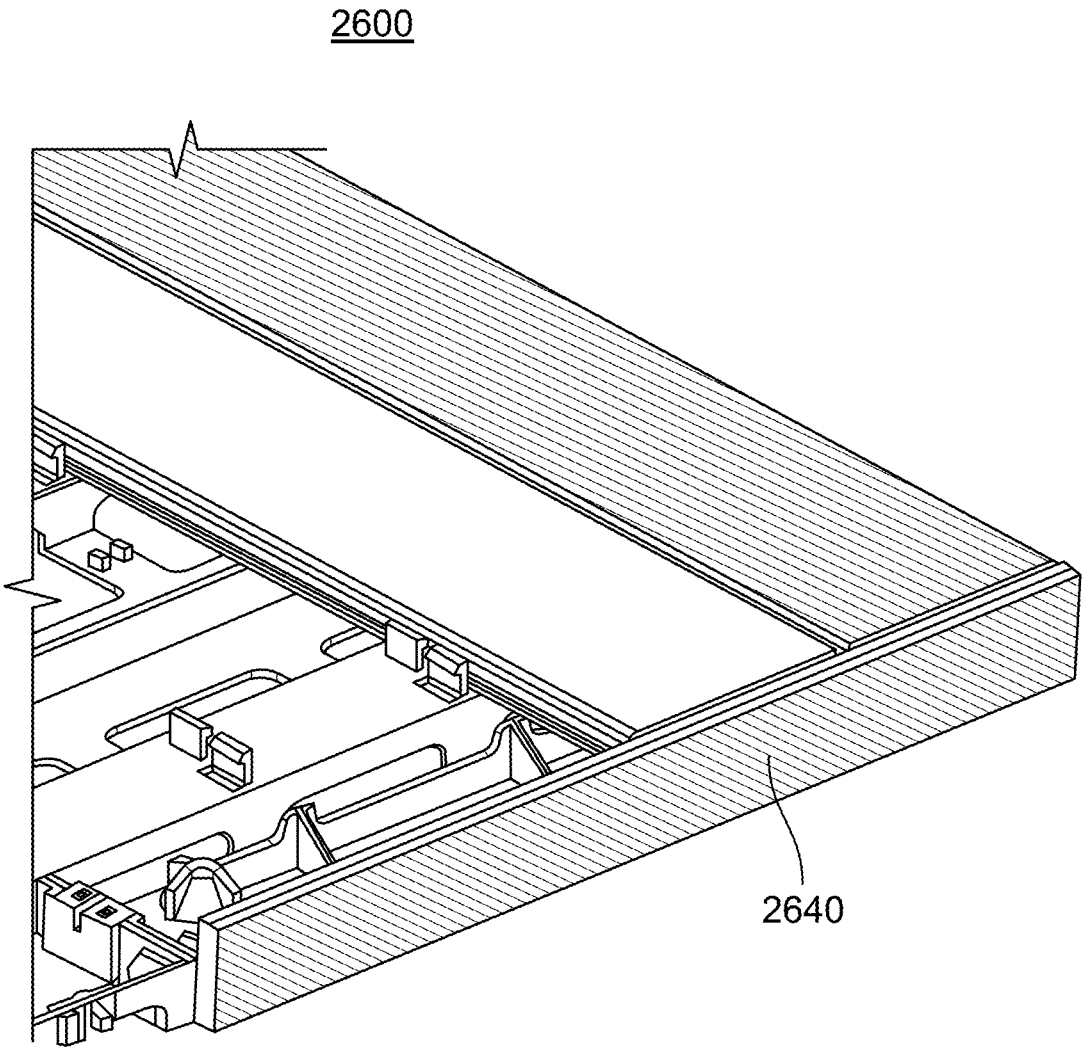

Referring to FIG. 28B, another illustration of the deck board assembly 2600 is illustrated. A solid wooden component 2640 will also be placed on the exterior of the deck board assembly 2600 for enhanced aesthetic appeal and structural enhancement. Instead of the exterior trim as in other embodiments, the deck board assembly 2600 will use the solid wooden component 2640 for an enhanced structure and for an enhanced aesthetic appeal.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments and that the list is not intended to represent a closed list exclusive of further embodiments. Such wording may include "e.g.," "etc.," "such as," "for example," "and so forth," "and the like," etc., and other wording as will be apparent from the surrounding context.

The invention claimed is:

1. A deck tile assembly comprising:

a frame having at least four sides defining a first plane;

a plurality of bars for providing a support structure to the frame;

at least two parallel sleepers permanently attached between two opposite sides of the frame and mounted on the plurality of bars;

at least two step clip fastening devices, wherein each of the step clip fastening devices are mounted on one of the at least two parallel sleepers;

interlocking hooking connectors positioned underneath the at least two step clip fastening devices, wherein the hooking connectors are oriented to extend orthogonally to the first plane and are configured interlock with a second set of hooking connectors to enable the at least two step clip fastening devices to remain secured on the at least two parallel sleepers; and at least two supporting members for attaching the frame with a ground surface, wherein a stake is positioned through a cone-shaped through-hole to attach the frame with the ground surface.

2. The assembly of claim 1, wherein the stake is positioned at an angle through the cone-shaped hole.

3. The assembly of claim 1, wherein the deck tile assembly is one of multiple deck tile assemblies, each of the multiple deck tile assemblies including the hooking connectors.

4. The assembly stem of claim 1, a trimming apparatus is positioned at an exterior region of the deck tile assembly.

5. The assembly of claim 1, wherein each of the step clip fastening device comprises a plurality of step clips attached on a base strip of the step clip fastening device.

6. The assembly of claim 1, wherein each of the at least two supporting members have the cone shaped through hole at each end of the supporting member for attaching the frame with the ground surface with at least one fastener.

7. The assembly of claim 1, further comprising one or more deck boards positioned over one or more deck tile assemblies.

8. The assembly of claim 1, further comprising a skirting removably attached on an outer surface of each side of the frame.

9. The assembly of claim 8, wherein the skirting comprises a plurality of locking mechanisms for attaching the skirting with one side of the frame.

10. The assembly of claim 1, wherein a plurality of deck boards are mounted on the at least two step clip fastening devices.

11. The assembly of claim 1, wherein each step clip of the at least two step clip fastening devices includes an anchor protruding from an inner cavity of the step clip, the anchor configured to provide friction to deck boards mounted within the step clip.

12. A deck tile system comprising:

a deck tile assembly, wherein the assembly comprises:

a frame having at least four sides defining a first plane;

a plurality of bars for providing a support structure to the frame;

at least two parallel sleepers permanently attached between two opposite sides of the frame and mounted on the plurality of bars;

at least two step clip fastening devices including a plurality of step clips oriented to extend orthogonally to the first plane, wherein each of the step clip fastening device is mounted on one of the at least two parallel sleepers; and at least two supporting members for attaching the frame with the ground surface, wherein at least two stakes are positioned at an angle to attach the frame to the ground surface;

a plurality of deck boards attached to the deck tile assembly, wherein each of the plurality of deck boards are mounted between two step clips of each of the at least two step clip fastening devices; and interlocking hooking connectors positioned underneath the at least two step clip fastening devices, and positioned beneath the plurality of deck boards, wherein the hooking connectors are oriented to extend orthogonally to the first plane and are configured to interlock with a second set of hooking connectors.

13. The system of claim 12, wherein the at least two stakes are each positioned through a cone-shaped through hole.

14. The system of claim 12, wherein each of the at least two supporting members have a hole at each end of the supporting member for attaching the frame with the ground surface with at least one fastener.

15. The system of claim 12, further comprising a plurality of locking mechanisms at each side of the frame for attaching one or more deck tile assemblies.

16. A method of assembling at least two deck tile assemblies, the method comprising the steps of:

placing a first deck tile assembly according to claim 1 on a ground surface and placing a second deck tile according to claim 1 assembly adjacent to the first deck tile assembly;

aligning a plurality of grooves of the first deck tile assembly with a plurality of protrusions of the second deck tile assembly;

aligning a plurality of protrusions of the first deck tile assembly with a plurality of grooves of the second deck tile assembly;

fastening the first deck tile assembly and the second deck tile assembly by engaging the plurality of grooves with the plurality of protrusions; and attaching a plurality of skirting enclosing a periphery of the two assembled deck tile assemblies.

17. The method of claim 16, further comprising:

attaching the first deck tile assembly to a ground surface by using one or more fasteners; and attaching the second deck tile assembly to the ground surface by using the one or more fasteners.

18. The method of claim 16, wherein each skirting is removably attached to the periphery of the two assembled deck tile assemblies.

* * * * *